US011827031B2

(12) United States Patent
Sakai et al.

(10) Patent No.: US 11,827,031 B2
(45) Date of Patent: Nov. 28, 2023

(54) LIQUID EJECTING APPARATUS AND CONTROL METHOD OF LIQUID EJECTING APPARATUS

(71) Applicant: SEIKO EPSON CORPORATION, Tokyo (JP)

(72) Inventors: Nanami Sakai, Matsumoto (JP); Ayumi Yokoo, Matsumoto (JP); Rei Nakayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 199 days.

(21) Appl. No.: 17/305,608

(22) Filed: Jul. 12, 2021

(65) Prior Publication Data

US 2022/0016898 A1 Jan. 20, 2022

(30) Foreign Application Priority Data

Jul. 15, 2020 (JP) ..... 2020-121168
Jul. 15, 2020 (JP) ..... 2020-121169
Jul. 17, 2020 (JP) ..... 2020-122823

(51) Int. Cl.
*B41J 2/175* (2006.01)

(52) U.S. Cl.
CPC ..... *B41J 2/17596* (2013.01)

(58) Field of Classification Search
CPC .. B41J 2/17556; B41J 2/17596; B41J 2/1707; B41J 2/18; B41J 2/17566; B41J 2002/17579
See application file for complete search history.

(56) References Cited

U.S. PATENT DOCUMENTS 8,449,087 B2 * 5/2013 Kataoka ..... B41J 2/18 347/85
9,994,040 B2 * 6/2018 Karita ..... B41J 2/1707
11,077,671 B2 * 8/2021 Wakasa ..... B41J 2/18
2009/0174735 A1 7/2009 Yamada
2010/0085396 A1 4/2010 Yokota et al.

FOREIGN PATENT DOCUMENTS

EP 0916502 5/1999
EP 3121011 A 1/2017
JP 2014-024189 A 2/2014
JP 2015-174378 A 10/2015
JP 2019-014152 A 1/2019
WO 2020-036583 2/2020

* cited by examiner

*Primary Examiner* — An H Do
(74) *Attorney, Agent, or Firm* — WORKMAN NYDEGGER

(57) ABSTRACT

A liquid ejecting apparatus includes: a liquid ejecting head configured to eject a liquid from a nozzle provided on a nozzle surface; a first storage portion that has an introduction portion into which the liquid accommodated in a liquid accommodating portion is introduced, the introduction portion being provided at an upper portion of the first storage portion; a second storage portion that communicates with the first storage portion via a communication passage and to which the liquid is supplied from the first storage portion due to a water head difference; a supply flow path for supplying the liquid from the second storage portion to the liquid ejecting head; a pressurizing portion that pressurizes an inside of the second storage portion; and a first valve configured to close the communication passage at the time of pressurization by the pressurizing portion.

19 Claims, 18 Drawing Sheets

LIQUID EJECTING APPARATUS AND CONTROL METHOD OF LIQUID EJECTING APPARATUS

The present application is based on, and claims priority from JP Application Serial Number 2020-121168, filed Jul. 15, 2020, JP Application Serial Number 2020-121169, filed Jul. 15, 2020, and JP Application Serial Number 2020-122823, filed Jul. 17, 2020, the disclosures of which are hereby incorporated by reference herein in their entirety.

BACKGROUND

1. Technical Field

The present disclosure relates to a liquid ejecting apparatus such as a printer.

2. Related Art

For example, as disclosed in JP-A-2014-024189, there is a recording apparatus, which is an example of a liquid ejecting apparatus, which ejects an ink, which is an example of a liquid, from a nozzle formed in a recording head, which is an example of a liquid ejecting head, to perform printing. The recording apparatus sucks the ink from the nozzle by operating a suction pump with a cap in contact with the recording head.

In the suction cleaning that sucks and discharges the liquid, the inside of the liquid ejecting head becomes a negative pressure even after the suction cleaning is completed. Therefore, there is a possibility that the recording head draws the liquid adhering to the nozzle surface on which the nozzle is provided by suction from the nozzle, and the liquids may be mixed in the recording head.

SUMMARY

According to an aspect of the present disclosure, there is provided a liquid ejecting apparatus including: a liquid ejecting head configured to eject a liquid from a nozzle provided on a nozzle surface; a first storage portion that has an introduction portion into which the liquid accommodated in a liquid accommodating portion is introduced, the introduction portion being provided at an upper portion of the first storage portion, the first storage portion being configured so that a liquid level fluctuates in a range lower than the nozzle surface; a second storage portion that communicates with the first storage portion via a communication passage and to which the liquid is supplied from the first storage portion due to a water head difference; a supply flow path for supplying the liquid from the second storage portion to the liquid ejecting head; a pressurizing portion that pressurizes an inside of the second storage portion; and a first valve configured to close the communication passage at the time of pressurization by the pressurizing portion.

DESCRIPTION OF EXEMPLARY EMBODIMENTS

First Embodiment

Figure 1:
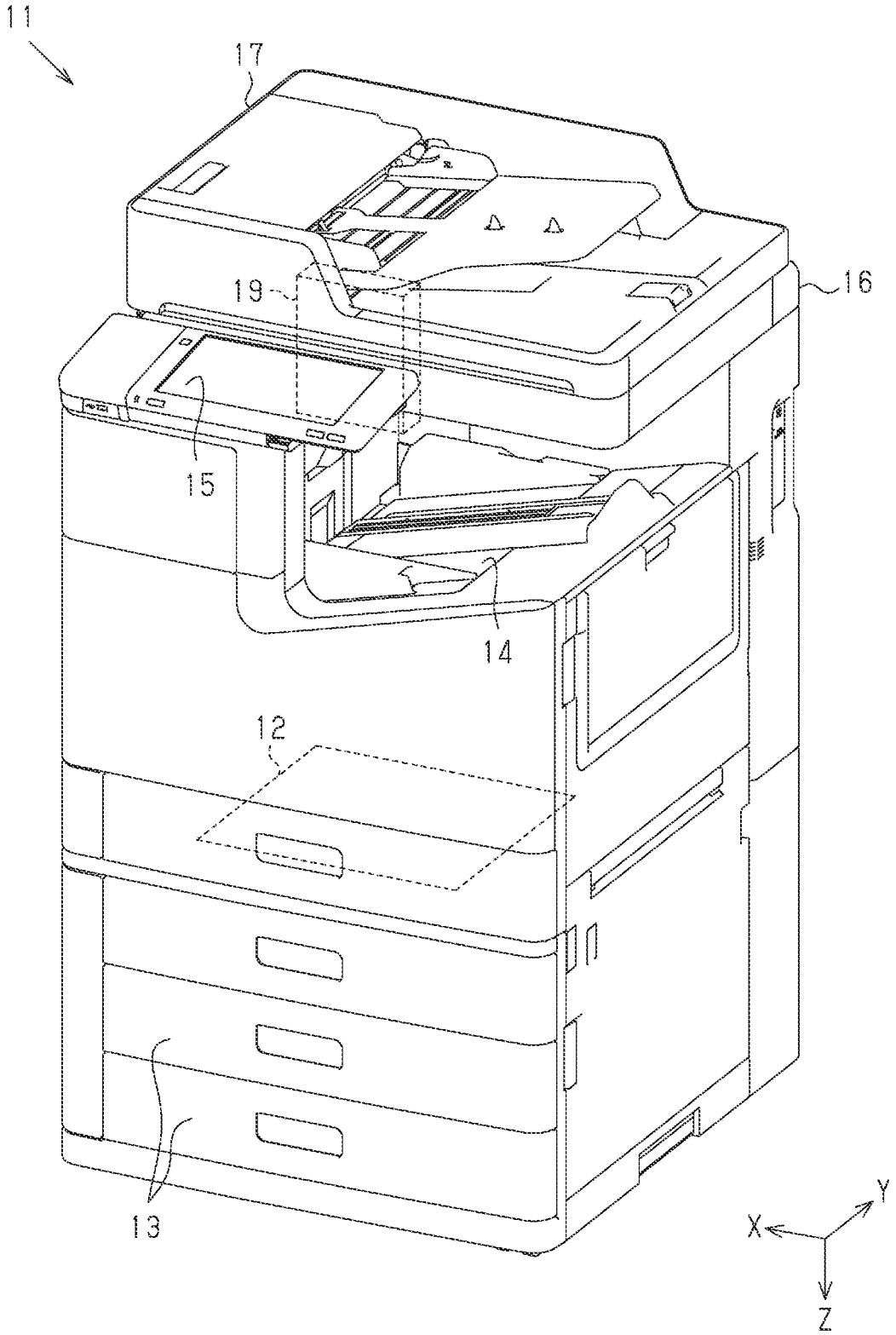
FIG. 1 is a perspective view of a liquid ejecting apparatus according to a first embodiment.

Hereinafter, a liquid ejecting apparatus and a control method of the liquid ejecting apparatus according to a first embodiment will be described with reference to the drawings. The liquid ejecting apparatus is an ink jet printer that ejects ink, which is an example of a liquid, to perform printing on a medium such as a paper sheet.

In the drawing, the direction of gravity is indicated by a Z axis, and the directions along the horizontal plane are indicated by an X axis and a Y axis, assuming that a liquid ejecting apparatus 11 is placed on the horizontal plane. The X axis, the Y axis, and the Z axis are orthogonal to one another.

As illustrated in FIG. 1, the liquid ejecting apparatus 11 may include a medium accommodating portion 13 capable of accommodating a medium 12, a stacker 14 for receiving the printed medium 12, and an operation portion 15 such as a touch panel for operating the liquid ejecting apparatus 11. The liquid ejecting apparatus 11 may include an image reading portion 16 that reads an image of an original document and an automatic feeding portion 17 that sends the original document to the image reading portion 16.

The liquid ejecting apparatus 11 includes a control portion 19 that controls various operations performed by the liquid ejecting apparatus 11. The control portion 19 is composed of, for example, a computer, a processing circuit including a memory, and the like, and performs control according to a program stored in the memory.

Figure 2:
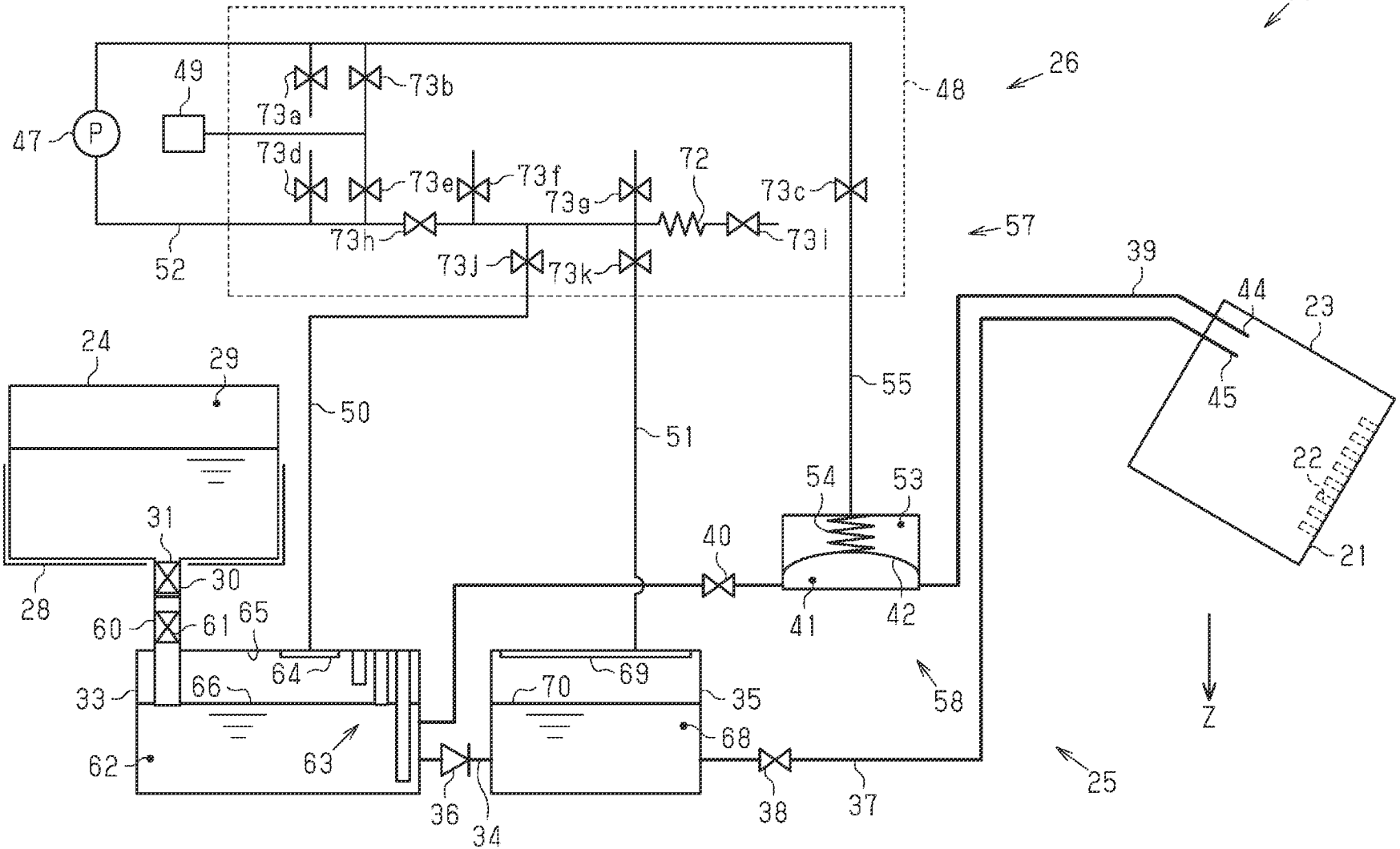
FIG. 2 is a schematic diagram of a supply mechanism and a drive mechanism included in the liquid ejecting apparatus according to the first embodiment.

As illustrated in FIG. 2, the liquid ejecting apparatus 11 includes a liquid ejecting head 23 for ejecting the liquid from a nozzle 22 provided on a nozzle surface 21 and a supply mechanism 25 for supplying the liquid accommodated in a liquid accommodating portion 24 to the liquid ejecting head 23, and a drive mechanism 26 for driving the supply mechanism 25. The liquid ejecting apparatus 11 may include a plurality of supply mechanisms 25. The plurality of supply mechanisms 25 may supply different types of liquids to the liquid ejecting head 23. For example, the liquid ejecting apparatus 11 may eject a plurality of colors of ink supplied by the plurality of supply mechanisms 25 to perform color printing. One drive mechanism 26 may drive a plurality of supply mechanisms 25 together. The liquid ejecting apparatus 11 may include a plurality of drive mechanisms 26 that individually drive the plurality of supply mechanisms 25.

The liquid ejecting head 23 may be provided detachably from the main body of the liquid ejecting apparatus 11. The liquid ejecting head 23 is disposed so that the nozzle surface 21 is inclined with respect to the horizontal in an inclined posture. The liquid ejecting head 23 may eject the liquid to the medium 12 in an inclined posture to perform printing. The liquid ejecting head 23 of the present embodiment is a line type provided over a width direction of the medium 12. The liquid ejecting head 23 may be configured as a serial type that performs printing while moving in the width direction of the medium 12.

The supply mechanism 25 may include a mounting portion 28 to which the liquid accommodating portion 24 is detachably mounted. The liquid accommodating portion 24 may include an accommodation chamber 29 for accommodating the liquid, a flowing-out portion 30 for flowing out the liquid accommodated in the accommodation chamber 29, and an accommodating portion-side valve 31 provided in the flowing-out portion 30. The accommodation chamber 29 of the present embodiment is a closed space that is not communicated with the atmosphere. The liquid accommodating portion 24 before being mounted on the mounting portion 28 may accommodate a larger amount of liquid than the amount of liquid that the supply mechanism 25 can hold.

The supply mechanism 25 includes a first storage portion 33 that stores the liquid supplied from the liquid accommodating portion 24, a communication passage 34 of which an upstream end is coupled to the first storage portion 33, and a second storage portion 35 to which a downstream end of the communication passage 34 is coupled. That is, the second storage portion 35 communicates with the first storage portion 33 via the communication passage 34. The supply mechanism 25 includes a first valve 36 capable of closing the communication passage 34, and a supply flow path 37 for supplying liquid from the second storage portion 35 to the liquid ejecting head 23. The supply mechanism 25 may include a second valve 38 provided in the supply flow path 37 between the second storage portion 35 and the liquid ejecting head 23, a collection flow path 39 for collecting the liquid from the liquid ejecting head 23 to the first storage portion 33, a third valve 40 capable of opening and closing the collection flow path 39, and a liquid chamber 41 provided in the collection flow path 39.

The liquid chamber 41 is provided in the collection flow path 39 between the liquid ejecting head 23 and the third valve 40. The liquid chamber 41 is partially composed of a flexible member 42, and the volume of the liquid chamber 41 changes as the flexible member 42 is deformed.

The liquid ejecting head 23 may have a first coupling portion 44 to which the collection flow path 39 is coupled and a second coupling portion 45 to which the supply flow path 37 is coupled. An upstream end of the collection flow path 39 is coupled to the first coupling portion 44, and a downstream end thereof is coupled to the first storage portion 33. An upstream end of the supply flow path 37 is coupled to the second storage portion 35, and a downstream end thereof is coupled to the second coupling portion 45. In the inclined posture, the first coupling portion 44 between the liquid ejecting head 23 and the collection flow path 39 may be disposed at a position higher than the second coupling portion 45 between the liquid ejecting head 23 and the supply flow path 37.

The drive mechanism 26 includes a pressurizing portion 47 that pressurizes the inside of the second storage portion 35. The drive mechanism 26 may include a switching mechanism 48 coupled to the pressurizing portion 47 and a pressure sensor 49 for detecting the pressure. The drive mechanism 26 may include an atmosphere opening path 50 coupled to the first storage portion 33, a pressurization flow path 51 coupled to the second storage portion 35, and a coupling flow path 52 that couples the atmosphere opening path 50 and the pressurization flow path 51 to the pressurizing portion 47. The drive mechanism 26 may include an air chamber 53 separated from the liquid chamber 41 via the flexible member 42, a spring 54 provided in the air chamber 53, and an air flow path 55 coupled to the air chamber 53. By pushing the flexible member 42, the spring 54 reduces the pressure fluctuation of the liquid in the collection flow path 39 and the liquid ejecting head 23.

The pressurizing portion 47 is, for example, a tube pump that sends the air by rotating the roller while crushing the tube. A tube (not illustrated) included in the pressurizing portion 47 has the air flow path 55 coupled to one end and the coupling flow path 52 coupled to the other end. The pressurizing portion 47 is driven to rotate in the normal direction to send the air taken in from the air flow path 55 to the coupling flow path 52. The pressurizing portion 47 is driven to rotate in the reverse direction to send the air taken in from the coupling flow path 52 to the air flow path 55.

In the present embodiment, the pressurizing portion 47, the air chamber 53, and the air flow path 55 through which the pressurizing portion 47 communicates with the air chamber 53 are included to form a pressurizing mechanism 57, the liquid chamber 41 is added to the pressurizing mechanism 57 to form a slight pressurizing portion 58. The slight pressurizing portion 58 has the liquid chamber 41 and the pressurizing mechanism 57 capable of pressurizing the flexible member 42 from the outside of the liquid chamber 41. The slight pressurizing portion 58 is provided in the collection flow path 39 between the liquid ejecting head 23 and the third valve 40, and pressurizes the liquid in the collection flow path 39.

Next, the first storage portion 33 will be described.

The first storage portion 33 has an introduction portion 60 into which the liquid accommodated in the liquid accommodating portion 24 mounted on the mounting portion 28 can be introduced. The first storage portion 33 may have a device-side valve 61 provided in the introduction portion 60, a first storage chamber 62 for storing liquid, a liquid amount sensor 63 for detecting the amount of liquid stored in the first storage chamber 62, and a first gas-liquid separation membrane 64 for separating the first storage chamber 62 and the atmosphere opening path 50 from each other. The first gas-liquid separation membrane 64 is a membrane having a property of allowing a gas to pass therethrough and preventing a liquid from passing therethrough.

The accommodating portion-side valve 31 and the device-side valve 61 are opened by mounting the liquid accommodating portion 24 on the mounting portion 28, and the open state is maintained while the liquid accommodating portion 24 is mounted on the mounting portion 28. When the liquid accommodating portion 24 is mounted on the mounting portion 28, the device-side valve 61 is configured to open before the accommodating portion-side valve 31, so that the possibility of liquid leaking from the liquid accommodating portion 24 can be reduced.

The introduction portion 60 is provided above the first storage portion 33. The introduction portion 60 of the present embodiment is provided so as to penetrate a ceiling 65 of the first storage chamber 62. The lower end of the introduction portion 60 is located in the first storage chamber 62 and below the ceiling 65. The upper end of the introduction portion 60 is located outside the first storage chamber 62 and above the ceiling 65. The introduction portion 60 is coupled to the flowing-out portion 30 included in the liquid accommodating portion 24 by mounting the liquid accommodating portion 24 on the mounting portion 28.

The lower end of the introduction portion 60 is located below the nozzle surface 21. As a result, a first liquid level 66 of the liquid stored in the first storage portion 33 fluctuates in a range lower than that of the nozzle surface 21. Specifically, the liquid in the liquid accommodating portion 24 is supplied to the first storage portion 33 by the head via the flowing-out portion 30 and the introduction portion 60. Air is introduced into the liquid accommodating portion 24 from the first storage portion 33 via the introduction portion 60 and the flowing-out portion 30 by the amount of the liquid supplied to the first storage portion 33. The first liquid level 66 rises by the amount of the supplied liquid. When the first liquid level 66 reaches the lower end of the introduction portion 60, the inflow of air from the first storage portion 33 to the liquid accommodating portion 24 is restricted. Since the accommodation chamber 29 is sealed, when the inflow of air is restricted, the pressure in the accommodation chamber 29 is reduced by the amount of the supplied liquid. When the negative pressure in the accommodation chamber 29 becomes larger than the head of the liquid in the accommodation chamber 29, the supply of the liquid from the liquid accommodating portion 24 to the first storage portion 33 is restricted.

The first liquid level 66 is lowered by supplying a liquid from the first storage portion 33 to the second storage portion 35. When the first liquid level 66 is lowered and air flows into the accommodation chamber 29 via the introduction portion 60 and the flowing-out portion 30, the negative pressure in the accommodation chamber 29 becomes small. When the negative pressure in the accommodation chamber 29 becomes smaller than the head of the liquid in the accommodation chamber 29, the liquid is supplied from the liquid accommodating portion 24 to the first storage portion 33. Therefore, while the liquid is accommodated in the liquid accommodating portion 24, the first liquid level 66 is maintained at a standard position, which is a position near the lower end of the introduction portion 60. When the liquid accommodated in the liquid accommodating portion 24 runs out, the first liquid level 66 is located below the standard position.

The liquid amount sensor 63 may detect that the first liquid level 66 is located at the standard position, the first liquid level 66 is located below the standard position, and the first liquid level 66 is located at the full position above the standard position. When the first liquid level 66 is located at the full position, the first storage portion 33 stores the maximum amount of liquid. When the liquid amount sensor 63 detects that the first liquid level 66 is located below the standard position, the control portion 19 may determine that the liquid accommodating portion 24 is empty and instruct a user to replace the liquid accommodating portion 24.

The standard position of the present embodiment is located above the position where the downstream end of the collection flow path 39 is coupled in the first storage chamber 62. Therefore, when the first liquid level 66 is in the standard position, the liquid in the first storage portion 33 can be supplied to the liquid ejecting head 23 via the collection flow path 39.

Next, the second storage portion 35 will be described.

The second storage portion 35 may have a second storage chamber 68 for storing the liquid and a second gas-liquid separation membrane 69 for separating the second storage chamber 68 and the pressurization flow path 51 from each other. Like the first gas-liquid separation membrane 64, the second gas-liquid separation membrane 69 is a membrane having a property of allowing a gas to pass therethrough and preventing a liquid from passing therethrough.

To the second storage portion 35, the liquid is supplied from the first storage portion 33 due to a water head difference. The first valve 36 may be configured to have a check valve that allows the flow of the liquid from the first storage portion 33 to the second storage portion 35 and restricts the flow of the liquid from the second storage portion 35 to the first storage portion 33. When the inside of the first storage chamber 62 and the inside of the second storage chamber 68 are at atmospheric pressure, a second liquid level 70 of the liquid in the second storage portion 35 becomes the same height as the first liquid level 66. In other words, the second liquid level 70 is maintained at a standard position that is substantially the same height as the lower end of the introduction portion 60, and fluctuates in a range lower than the nozzle surface 21. The liquid in the liquid ejecting head 23 is maintained at a negative pressure due to the water head difference between the liquid in the first storage portion 33 and the liquid in the second storage portion 35. When the liquid is consumed by the liquid ejecting head 23, the liquid stored in the second storage portion 35 is supplied to the liquid ejecting head 23.

The first valve 36 closes the communication passage 34 when the pressure in the second storage portion 35 is higher than the pressure in the first storage portion 33. Therefore, the first valve 36 closes the communication passage 34 when the pressurizing portion 47 pressurizes the inside of the second storage portion 35.

The opening and closing of the second valve 38 and the third valve 40 are controlled by the control portion 19. The second valve 38 is provided so that the supply flow path 37 can be opened and closed during the pressurization by the pressurizing portion 47. The third valve 40 is provided so that the collection flow path 39 can be opened and closed.

Next, the switching mechanism 48 will be described.

The switching mechanism 48 includes a thin tube portion 72 provided in the coupling flow path 52, and first selection valve 73*a* to eleventh selection valve 73*k* capable of opening and closing the flow path. The thin tube portion 72 is a thin and meandering tube to the extent that the flow of the liquid is greatly restricted with respect to the flow of air.

The first selection valve 73*a* communicates the air flow path 55 with the atmosphere by opening the valve. The second selection valve 73*b* communicates the air flow path 55 with the pressure sensor 49 by opening the valve. The third selection valve 73*c* opens the air flow path 55, and communicates the pressurizing portion 47 with the air chamber 53 by opening the valve.

The fourth selection valve 73*d* communicates the coupling flow path 52 between the pressurizing portion 47 and the eighth selection valve 73*h* with the atmosphere by opening the valve. The fifth selection valve 73*e* communicates the coupling flow path 52 with the pressure sensor 49 by opening the valve. The sixth selection valve 73*f* and the seventh selection valve 73*g* communicate the coupling flow path 52 with the atmosphere by opening the valves. The eighth selection valve 73*h* opens the coupling flow path 52 by opening the valve. The ninth selection valve 73*i* communicates the thin tube portion 72 with the atmosphere by opening the valve. The tenth selection valve 73*j* opens the atmosphere opening path 50 and communicates the first storage portion 33 with the coupling flow path 52 by opening the valve. The eleventh selection valve 73*k* opens the pressurization flow path 51 and communicates the second storage portion 35 with the coupling flow path 52 by opening the valve.

When the pressure in the air chamber 53 is changed, the switching mechanism 48 opens the second selection valve 73*b* to the fourth selection valve 73*d* and closes the other selection valves. In this state, when the pressurizing portion 47 is driven to rotate in the normal direction, the air in the air chamber 53 is discharged via the air flow path 55 and the coupling flow path 52, and the pressure in the air chamber 53 decreases. In this state, when the pressurizing portion 47 is driven to rotate in the reverse direction, air is sent to the air chamber 53 via the coupling flow path 52 and the air flow path 55, and the pressure in the air chamber 53 rises. At this time, the pressure sensor 49 may detect the pressure in the air flow path 55 and the air chamber 53. The control portion 19 may control the drive of the pressurizing portion 47 based on the detection result of the pressure sensor 49.

When the first storage portion 33 is opened to the atmosphere, the switching mechanism 48 opens the sixth selection valve 73*f* and the tenth selection valve 73*j*. The first storage chamber 62 communicates with the atmosphere via the atmosphere opening path 50 and the coupling flow path 52.

When the second storage portion 35 is opened to the atmosphere, the switching mechanism 48 opens the seventh selection valve 73*g* and the eleventh selection valve 73*k*. The second storage chamber 68 communicates with the atmosphere via the pressurization flow path 51 and the coupling flow path 52.

When the inside of the second storage portion 35 is pressurized, the switching mechanism 48 opens the first selection valve 73*a*, the fifth selection valve 73*e*, the eighth selection valve 73*h*, and the eleventh selection valve 73*k*, and closes the other selection valves. In this state, when the pressurizing portion 47 is driven to rotate in the normal direction, air flows into the second storage chamber 68 via the air flow path 55, the coupling flow path 52, and the pressurization flow path 51, and the pressure in the second storage chamber 68 rises. At this time, the pressure sensor 49 may detect the pressure in the coupling flow path 52, the pressurization flow path 51, and the second storage chamber 68. The control portion 19 may control the drive of the pressurizing portion 47 based on the detection result of the pressure sensor 49.

Next, a control method of the liquid ejecting apparatus 11 will be described with reference to the flowcharts illustrated in FIGS. 3 to 9. Here, the step order of each control method can be optionally replaced within a range that does not deviate from the purpose of each control method.

Figure 3:
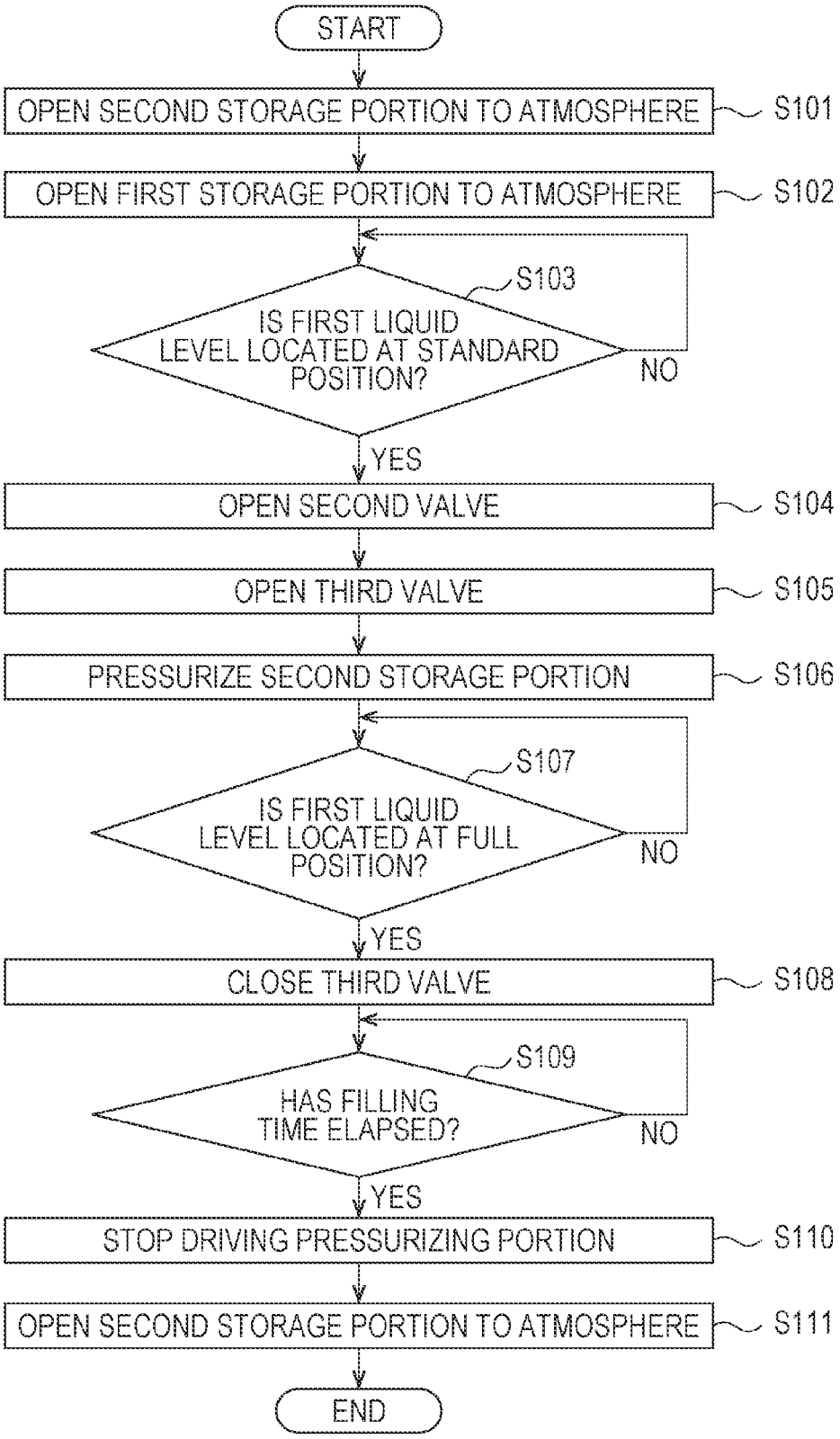
FIG. 3 is a flowchart illustrating a liquid filling routine of the first embodiment.

The liquid filling routine illustrated in FIG. 3 may be performed at the timing when the liquid accommodating portion 24 is first mounted on the mounting portion 28. The liquid filling routine may be performed at the timing when the liquid accommodating portion 24 is mounted on the mounting portion 28 after the liquid ejecting head 23 is replaced. In the initial state, the second valve 38, the third valve 40, and all the selection valves included in the switching mechanism 48 are closed.

In step S101, the control portion 19 opens the second storage portion 35 to the atmosphere. In step S102, the control portion 19 opens the first storage portion 33 to the atmosphere. In step S103, the control portion 19 determines whether or not the first liquid level 66 is located at the standard position. When the first liquid level 66 is not located at the standard position, step S103 becomes NO, and the control portion 19 waits until the first liquid level 66 is located at the standard position. When the first liquid level 66 is located at the standard position, step S103 becomes YES, and the control portion 19 shifts the process to step S104.

In step S104, the control portion 19 opens the second valve 38. In step S105, the control portion 19 opens the third valve 40. In step S106, the control portion 19 pressurizes the inside of the second storage portion 35.

In step S107, the control portion 19 determines whether or not the first liquid level 66 is located at the full position. When the first liquid level 66 is not located at the full position, step S107 becomes NO, and the control portion 19 waits until the first liquid level 66 is located at the full position. When the first liquid level 66 is located at the full position, step S107 becomes YES, and the control portion 19 shifts the process to step S108.

In step S108, the control portion 19 closes the third valve 40. In step S109, the control portion 19 determines whether or not the filling time has elapsed after the third valve 40 has been closed. The filling time is the time required to fill the liquid from the supply flow path 37 to the nozzle 22. When the filling time has not elapsed, step S109 becomes NO, and the control portion 19 waits until the filling time elapses. When the filling time elapses, step S109 becomes YES, and the control portion 19 shifts the process to step S110. In step S110, the control portion 19 stops driving the pressurizing portion 47. In step S111, the control portion 19 opens the second storage portion 35 to the atmosphere and ends the liquid filling routine.

Here, step S104 and step S105 each may be performed at the same time as step S106 or after step S106. Further, step S110 may be performed at the same time as step S111 or after step S111.

Next, the operation when liquid filling is performed will be described.

As illustrated in FIG. 2, when the liquid accommodating portion 24 is mounted on the mounting portion 28 and the first storage portion 33 is opened to the atmosphere, the liquid is supplied from the liquid accommodating portion 24 to the first storage portion 33. At this time, since the second storage portion 35 is also opened to the atmosphere, the liquid supplied to the first storage portion 33 also flows into the second storage portion 35. The first liquid level 66 and the second liquid level 70 rise to the standard position.

When the liquid amount sensor 63 detects that the first liquid level 66 is located at the standard position, the control portion 19 opens the second valve 38 and the third valve 40 and drives the pressurizing portion 47. The first valve 36 is closed when the pressure of the second storage portion 35 is higher than the pressure of the first storage portion 33, and closes the communication passage 34. Therefore, the liquid in the second storage portion 35 flows into the first storage portion 33 via the supply flow path 37, the liquid ejecting head 23, and the collection flow path 39.

When the liquid amount sensor 63 detects that the first liquid level 66 is located at the full position, the control portion 19 closes the third valve 40. As a result, the inflow of the liquid into the first storage portion 33 is stopped. The liquid in the second storage portion 35 is filled in the liquid ejecting head 23 and discharged from the nozzle 22.

When the liquid ejecting head 23 is filled with the liquid, the control portion 19 opens the second storage portion 35 to the atmosphere. As a result, the first valve 36 is opened and opens the communication passage 34. The liquid in the first storage portion 33 is supplied to the second storage portion 35 via the communication passage 34. The control portion 19 may close the second valve 38.

Figure 4:
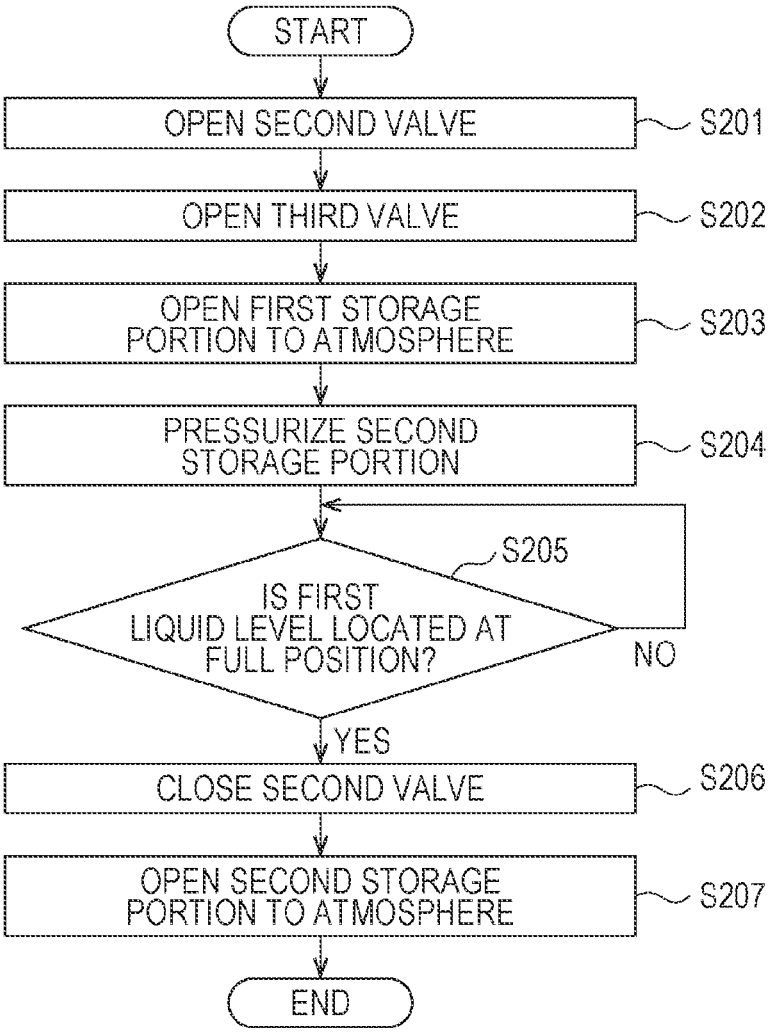
FIG. 4 is a flowchart illustrating a liquid circulation routine of the first embodiment.

The liquid circulation routine illustrated in FIG. 4 may be performed at the timing instructed to perform the liquid circulation. The liquid circulation is instructed to be performed, for example, after the liquid filling is performed and during the waiting time when printing or the like is not performed. The control portion 19 may periodically perform the liquid circulation routine.

In step S201, the control portion 19 opens the second valve 38. In step S202, the control portion 19 opens the third valve 40. In step S203, the control portion 19 opens the first storage portion 33 to the atmosphere. In step S204, the control portion 19 pressurizes the inside of the second storage portion 35.

In step S205, the control portion 19 determines whether or not the first liquid level 66 is located at the full position. When the first liquid level 66 is not located at the full position, step S205 becomes NO, and the control portion 19 waits until the first liquid level 66 is located at the full position. When the first liquid level 66 is located at the full position, step S205 becomes YES, and the control portion 19 shifts the process to step S206. In step S206, the control portion 19 closes the second valve 38. In step S207, the control portion 19 opens the second storage portion 35 to the atmosphere and ends the liquid circulation routine.

Here, step S201 and step S202 each may be performed at the same time as step S203 or after step S203, or may be performed at the same time as step S204 or after step S204. Further, step S206 may be performed at the same time as step S207 or after step S207.

Next, the operation when the liquid circulation is performed will be described.

As illustrated in FIG. 2, the control portion 19 opens the second valve 38 and the supply flow path 37 is opened by the second valve 38. The control portion 19 opens the third valve 40, and the collection flow path 39 is opened by the third valve 40.

The liquid ejecting apparatus 11 pressurizes the inside of the second storage portion 35 by the pressurizing portion 47, so that the liquid flows from the second storage portion 35 to the first storage portion 33 via the liquid ejecting head 23. At this time, the pressure of the second storage portion 35 becomes higher than the pressure of the first storage portion 33. Therefore, the first valve 36 is closed. That is, the liquid ejecting apparatus 11 pressurizes the inside of the second storage portion 35, so that the communication passage 34 is closed by the first valve 36.

Figure 5:
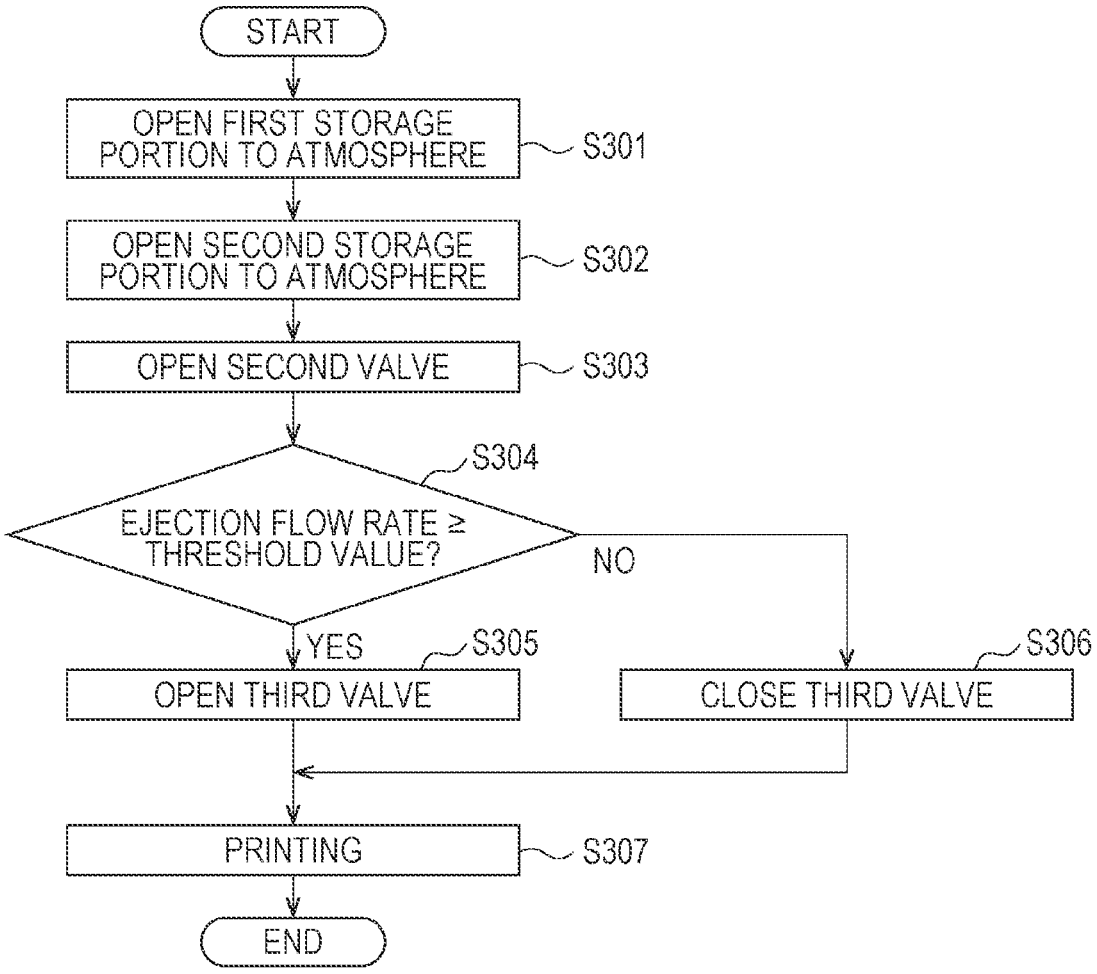
FIG. 5 is a flowchart illustrating a printing routine of the first embodiment.

The printing routine illustrated in FIG. 5 may be performed at the timing in which printing is instructed.

In step S301, the control portion 19 opens the first storage portion 33 to the atmosphere. In step S302, the control portion 19 opens the second storage portion 35 to the atmosphere. In step S303, the control portion 19 opens the second valve 38.

In step S304, the control portion 19 determines whether or not an ejection flow rate of the liquid generated by ejecting the liquid from the nozzle 22 during printing is equal to or greater than a threshold value. The control portion 19 may calculate the ejection flow rate from print data. When the ejection flow rate is equal to or greater than the threshold value, step S304 becomes YES, and the control portion 19 shifts the process to step S305. In step S305, the control portion 19 opens the third valve 40.

In step S304, when the ejection flow rate is less than the threshold value, step S304 becomes NO, and the control portion 19 shifts the process to step S306. In step S306, the control portion 19 closes the third valve 40. In step S307, the control portion 19 performs printing and ends the printing routine.

Here, step S301 and step S302 each may be performed at the same time as step S303 or after step S303, may be performed at the same time as step S305 or after step S305, or may be performed at the same time as step S306 or after step S306.

Next, the operation when the printing routine is performed will be described.

As illustrated in FIG. 2, in a case where the ejection flow rate when the liquid ejecting head 23 ejects the liquid to the medium 12 is less than the threshold value, the control portion 19 opens the second valve 38 and closes the third valve 40. That is, the control portion 19 performs printing in a state where the supply flow path 37 is opened by the second valve 38 and the collection flow path 39 is closed by the third valve 40. Therefore, the liquid is supplied to the liquid ejecting head 23 from the second storage portion 35 via the supply flow path 37.

When the ejection flow rate when the liquid ejecting head 23 ejects the liquid to the medium 12 is equal to or greater than the threshold value, the control portion 19 opens the second valve 38 and the third valve 40. That is, the control portion 19 performs printing in a state where the supply flow path 37 is opened by the second valve 38 and the collection flow path 39 is opened by the third valve 40. Therefore, the liquid is supplied from the second storage portion 35 to the liquid ejecting head 23 via the supply flow path 37, and the liquid is also supplied from the first storage portion 33 via the collection flow path 39.

Figure 6:
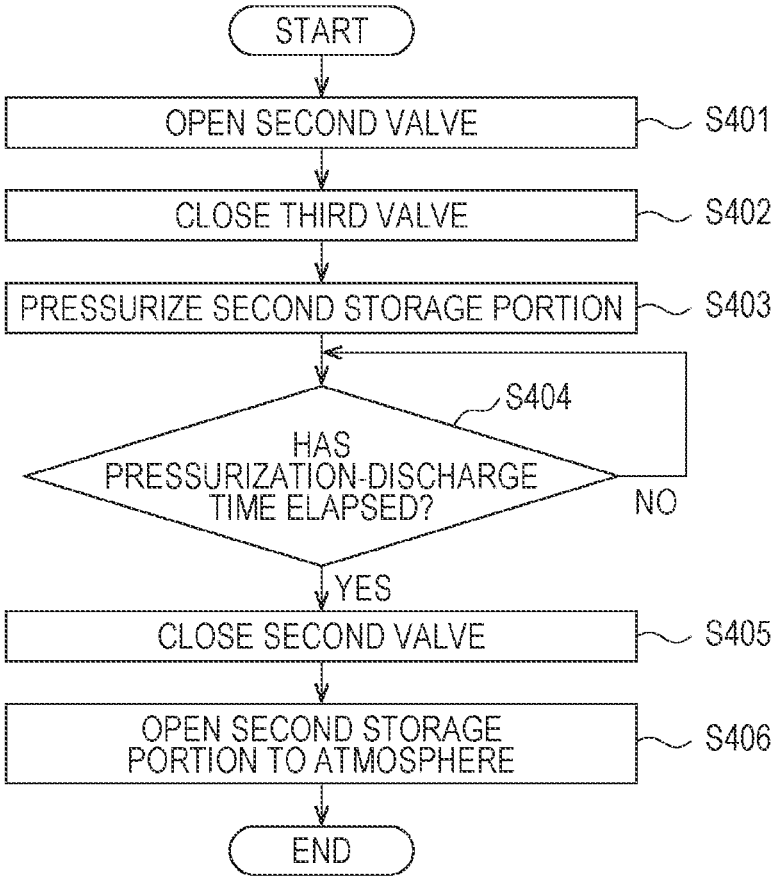
FIG. 6 is a flowchart illustrating a pressurization-discharge routine of the first embodiment.

The pressurization-discharge routine illustrated in FIG. 6 is performed when the performing of the pressurization-discharge is instructed, or when an ejection failure occurs in which the liquid cannot be normally ejected from the nozzle 22.

In step S401, the control portion 19 opens the second valve 38. In step S402, the control portion 19 closes the third valve 40. In step S403, the control portion 19 pressurizes the inside of the second storage portion 35. In step S404, the control portion 19 determines whether or not a pressurization-discharge time has elapsed after the inside of the second storage portion 35 has been pressurized. The pressurization-discharge time is a time required for the pressure for pressurizing the second storage portion 35 to be transmitted to the nozzle 22 via the supply flow path 37, to discharge the liquid from the nozzle 22, and to restore the state of the nozzle 22.

Step S404 becomes NO until the pressurization-discharge time elapses, and the control portion 19 waits until the pressurization-discharge time elapses. When the pressurization-discharge time elapses, step S404 becomes YES, and the control portion 19 shifts the process to step S405. In step S405, the control portion 19 closes the second valve 38. In step S406, the control portion 19 opens the second storage portion 35 to the atmosphere and ends the pressurization-discharge routine.

Here, step S401 and step S402 each may be performed at the same time as step S403 or after step S403. Further, step S405 may be performed at the same time as step S406 or after step S406.

Next, the operation when the pressurization-discharge is performed will be described.

As illustrated in FIG. 2, the liquid ejecting apparatus 11 pressurizes the inside of the second storage portion 35 by the pressurizing portion 47 and discharges the liquid from the nozzle 22. At this time, since the pressure of the second storage portion 35 becomes higher than the pressure of the first storage portion 33, the first valve 36 is closed. That is, the liquid ejecting apparatus 11 pressurizes the second storage portion 35, so that the communication passage 34 is closed by the first valve 36.

When the pressurization-discharge time elapses after the inside of the second storage portion 35 has been pressurized, the control portion 19 closes the second valve 38. As a result, the discharge of the liquid from the nozzle 22 is stopped. When the second storage portion 35 is opened to the atmosphere, the first valve 36 is opened, and the liquid is supplied from the first storage portion 33 to the second storage portion 35.

Figure 7:
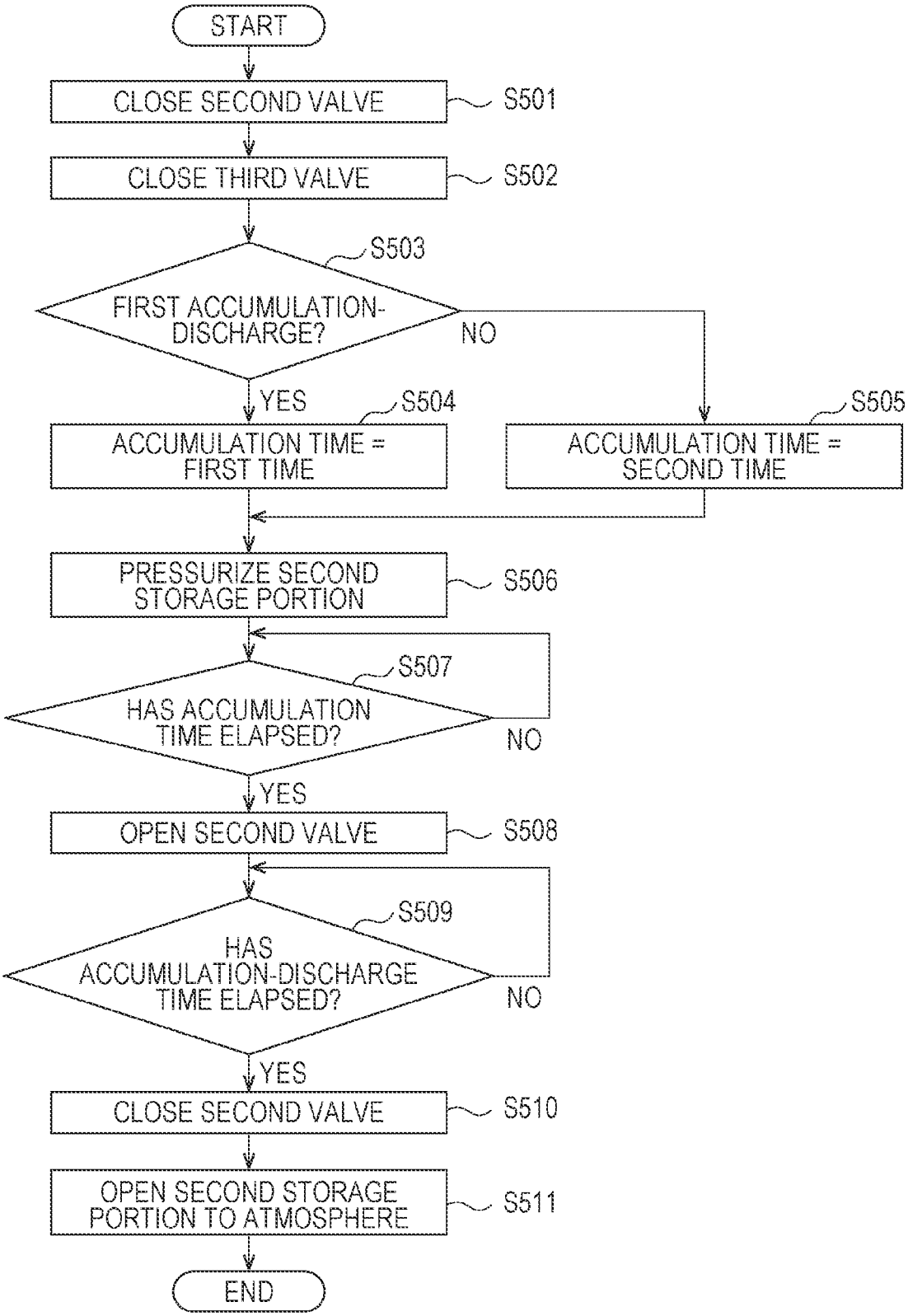
FIG. 7 is a flowchart illustrating an accumulation-discharge routine of the first embodiment.

The accumulation-discharge routine illustrated in FIG. 7 may be performed when the performing of the accumulation-discharge is instructed, or when the ejection failure is not improved even if the pressurization-discharge is performed.

In step S501, the control portion 19 closes the second valve 38. In step S502, the control portion 19 closes the third valve 40. In step S503, the control portion 19 determines whether the performing of a first accumulation-discharge is instructed or the performing of a second accumulation-discharge in which the pressure accumulated is smaller than that of the first accumulation-discharge is instructed, in the accumulation-discharge. When the first accumulation-discharge is performed, step S503 becomes YES, and the control portion 19 shifts the process to step S504. In step S504, the control portion 19 sets an accumulation time to a first time.

When the second accumulation-discharge is performed in step S503, step S503 becomes NO, and the control portion 19 shifts the process to step S505. In step S505, the control portion 19 sets the accumulation time to a second time shorter than the first time.

In step S506, the control portion 19 pressurizes the inside of the second storage portion 35. In step S507, the control portion 19 determines whether or not the accumulation time has elapsed after the pressurization in the second storage portion 35 has been started. When the accumulation time has not elapsed, step S507 becomes NO, and the control portion 19 waits until the accumulation time elapses. When the accumulation time elapses, step S507 becomes YES, and the control portion 19 shifts the process to step S508.

In step S508, the control portion 19 opens the second valve 38. In step S509, the control portion 19 determines whether or not an accumulation-discharge time has elapsed after the second valve 38 has been opened. The accumulation-discharge time is a time required for the pressure accumulated in the second storage portion 35 to be transmitted to the nozzle 22 via the supply flow path 37 and to discharge the liquid from the nozzle 22.

Step S509 becomes NO until the accumulation-discharge time elapses, and the control portion 19 waits until the accumulation-discharge time elapses. When the accumulation-discharge time elapses, step S509 becomes YES, and the control portion 19 shifts the process to step S510. In step S510, the control portion 19 closes the second valve 38. In step S511, the control portion 19 opens the second storage portion 35 to the atmosphere and ends the accumulation-discharge routine.

Here, step S501 and step S502 each may be performed at the same time as the start of pressurization in step S506, or immediately after the start of pressurization in step S506. Further, step S510 may be performed at the same time as step S511 or after step S511. Further, step S510 may not be performed.

Next, the operation when the accumulation-discharge is performed will be described.

As illustrated in FIG. 2, the control portion 19 closes the second valve 38 and the supply flow path 37 is closed by the second valve 38. The liquid ejecting apparatus 11 pressurizes the inside of the second storage portion 35 by the pressurizing portion 47. At this time, since the pressure of the second storage portion 35 becomes higher than the pressure of the first storage portion 33, the first valve 36 is closed. That is, the liquid ejecting apparatus 11 pressurizes the second storage portion 35, so that the communication passage 34 is closed by the first valve 36.

In the liquid ejecting apparatus 11, the pressurizing portion 47 pressurizes the inside of the second storage portion 35, then the second valve 38 opens the supply flow path 37, and the liquid is discharged from the nozzle 22. The magnitude of the pressure accumulated in the second storage portion 35 is proportional to the time for pressurizing the inside of the second storage portion 35 in a state where the communication passage 34 and the supply flow path 37 are closed. In the first accumulation-discharge, the time for pressurizing the inside of the second storage portion 35 by the pressurizing portion 47 is a first time. In the second accumulation-discharge, the time for pressurizing the inside of the second storage portion 35 by the pressurizing portion 47 is a second time shorter than the first time. The pressure accumulated in the first accumulation-discharge is greater than the pressure accumulated in the second accumulation-discharge. That is, in the first accumulation-discharge, the supply flow path 37 is opened by the second valve 38 when the inside of the second storage portion 35 is pressurized with a first pressure. In the second accumulation-discharge, the supply flow path 37 is opened by the second valve 38 when the inside of the second storage portion 35 is pressurized with a second pressure lower than the first pressure.

When the accumulation-discharge time elapses after the inside of the second storage portion 35 has been pressurized, the control portion 19 closes the second valve 38. As a result, the discharge of the liquid from the nozzle 22 is stopped. When the second storage portion 35 is opened to the atmosphere, the first valve 36 is opened, and the liquid is supplied from the first storage portion 33 to the second storage portion 35.

Figure 8:
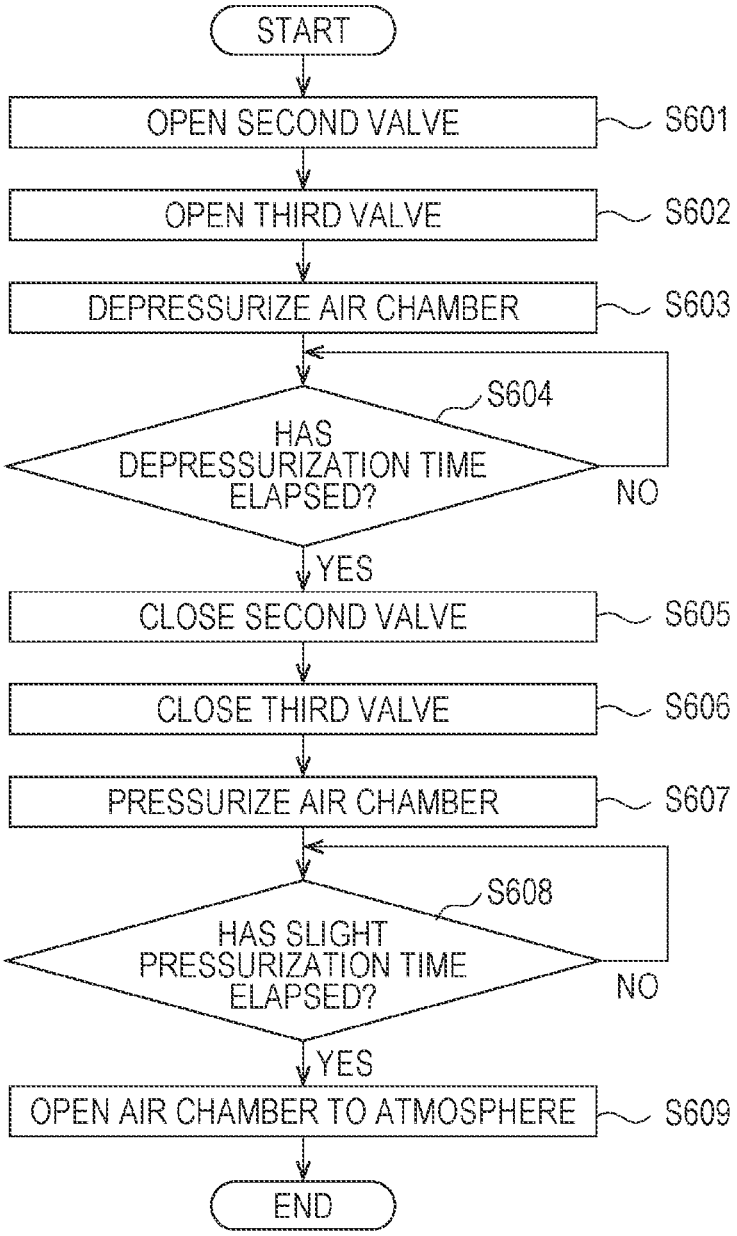
FIG. 8 is a flowchart illustrating a slight pressurization-discharge routine of the first embodiment.

The slight pressurization-discharge routine illustrated in FIG. 8 may be performed when the performing of the slight pressurization-discharge is instructed.

In step S601, the control portion 19 opens the second valve 38. In step S602, the control portion 19 opens the third valve 40. In step S603, the control portion 19 depressurizes the air chamber 53. In step S604, the control portion 19 determines whether or not the depressurization time has elapsed after the air chamber 53 has been depressurized. The depressurization time is a time required to deform the flexible member 42 and maximize the volume of the liquid chamber 41.

Step S604 becomes NO until the depressurization time elapses, and the control portion 19 waits until the depressurization time elapses. When the depressurization time elapses, step S604 becomes YES, and the control portion 19 shifts the process to step S605. In step S605, the control portion 19 closes the second valve 38. In step S606, the control portion 19 closes the third valve 40. In step S607, the control portion 19 pressurizes the air chamber 53.

In step S608, the control portion 19 determines whether or not the slight pressurization time has elapsed after the air chamber 53 has been pressurized. The slight pressurization time is a time required for the pressure for pressurizing the air chamber 53 to be transmitted to the nozzle 22 via the liquid chamber 41 and the collection flow path 39.

Step S608 becomes NO until the slight pressurization time elapses, and the control portion 19 waits until the slight pressurization time elapses. When the slight pressurization time elapses, step S608 becomes YES, and the control portion 19 shifts the process to step S609. In step S609, the control portion 19 opens the air chamber 53 to the atmosphere and ends the slight pressurization-discharge routine.

Here, step S601 and step S602 each may be performed at the same time as step S603 or after step S603. Further, step S605 and step S606 each may be performed during step S603, may be performed at the same time as the end of step S603, or may be performed after the end of step S603. Further, step S605 and step S606 each may be performed at the same time as step S607 or after step S607.

Next, the operation in the case of performing slight pressurization-discharge will be described.

As illustrated in FIG. 2, the control portion 19 opens the supply flow path 37 and the collection flow path 39 by opening the second valve 38 and the third valve 40. The control portion 19 depressurizes the air chamber 53 and deforms the flexible member 42 to increase the volume of the liquid chamber 41. The liquid flows into the liquid chamber 41 from the first storage portion 33 via the collection flow path 39, and the liquid flows from the second storage portion 35 via the supply flow path 37 and the collection flow path 39.

When the volume of the liquid chamber 41 is maximized, the control portion 19 closes the second valve 38, and the supply flow path 37 is closed by the second valve 38. The control portion 19 closes the third valve 40, and the collection flow path 39 is closed by the third valve 40. In this state, the liquid ejecting apparatus 11 pressurizes the flexible member 42 by sending pressurized air to the air chamber 53 by the pressurizing portion 47. That is, the liquid ejecting apparatus 11 pressurizes the flexible member 42 by the pressurizing mechanism 57 and discharges the liquid from the nozzle 22. The pressurizing mechanism 57 pressurizes the liquid chamber 41 with a pressure that breaks the meniscus formed in the nozzle 22. The amount of liquid discharged from the liquid ejecting head 23 by the slight pressurization-discharge is less than the amount of liquid discharged from the liquid ejecting head 23 by the pressurization-discharge.

Figure 9:
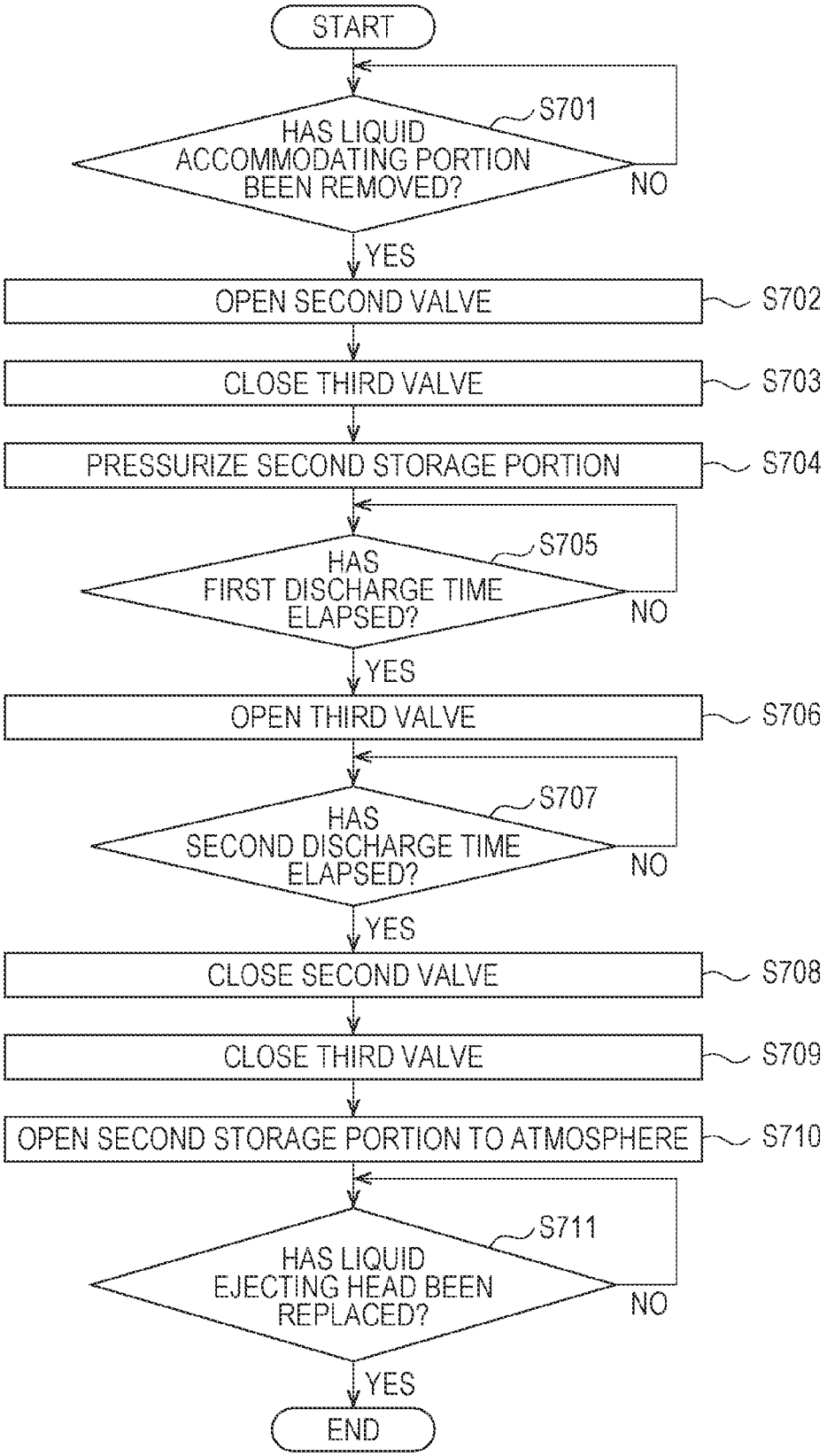
FIG. 9 is a flowchart illustrating a head replacement routine of the first embodiment.

The head replacement routine illustrated in FIG. 9 may be performed when the liquid ejecting head 23 is replaced.

In step S701, the control portion 19 determines whether or not the liquid accommodating portion 24 has been removed from the mounting portion 28. When the liquid accommodating portion 24 is mounted on the mounting portion 28, step S701 becomes NO, and the control portion 19 waits until the liquid accommodating portion 24 is removed. When the liquid accommodating portion 24 is removed, step S701 becomes YES, and the control portion 19 shifts the process to step S702.

In step S702, the control portion 19 opens the second valve 38. In step S703, the control portion 19 closes the third valve 40. In step S704, the control portion 19 pressurizes the inside of the second storage portion 35. In step S705, the control portion 19 determines whether or not a first discharge time has elapsed after the inside of the second storage portion 35 has been pressurized. The first discharge time is a time required to discharge the liquid stored in the second storage portion 35 via the supply flow path 37 and the liquid ejecting head 23.

Step S705 becomes NO until the first discharge time elapses, and the control portion 19 waits until the first discharge time elapses. When the first discharge time elapses, step S705 becomes YES, and the control portion 19 shifts the process to step S706. In step S706, the control portion 19 opens the third valve 40.

In step S707, the control portion 19 determines whether or not a second discharge time has elapsed after the third valve 40 has been opened. The second discharge time is a time required to collect the liquid in the collection flow path 39 to the first storage portion 33.

Step S707 becomes NO until the second discharge time elapses, and the control portion 19 waits until the second discharge time elapses. When the second discharge time elapses, step S707 becomes YES, and the control portion 19 shifts the process to step S708. In step S708, the control portion 19 closes the second valve 38. In step S709, the control portion 19 closes the third valve 40.

In step S710, the control portion 19 opens the second storage portion 35 to the atmosphere. In step S711, the control portion 19 determines whether or not the liquid ejecting head 23 has been replaced. When the liquid ejecting head 23 has not been replaced, step S711 becomes NO, and the control portion 19 waits until the liquid ejecting head 23 is replaced. When the liquid ejecting head 23 is replaced, step S711 becomes YES, and the control portion 19 ends the head replacement routine.

Here, step S702 and step S703 each may be performed at the same time as the start of pressurization in step S704, or immediately after the start of pressurization in step S704. Further, step S708 and step S709 each may be performed at the same time as step S710 or after step S710.

Next, the head replacement routine will be described.

As illustrated in FIG. 2, when the liquid ejecting head 23 is replaced, an operator performs the head replacement routine and removes the liquid accommodating portion 24 from the mounting portion 28. Subsequently, the control portion 19 opens the second valve 38, and the supply flow path 37 is opened by the second valve 38. The control portion 19 closes the third valve 40, and the collection flow path 39 is closed by the third valve 40. In this state, the control portion 19 pressurizes the inside of the second storage portion 35.

Specifically, the liquid ejecting apparatus 11 pressurizes the inside of the second storage portion 35 by the pressurizing portion 47, and discharges the liquid from the second storage portion 35 to the liquid ejecting head 23 from the nozzle 22. At this time, since the pressure of the second storage portion 35 becomes higher than the pressure of the first storage portion 33, the first valve 36 is closed. That is, the liquid ejecting apparatus 11 pressurizes the second storage portion 35, so that the communication passage 34 is closed by the first valve 36.

When the liquid in the second storage portion 35, the supply flow path 37, and the liquid ejecting head 23 is discharged, the control portion 19 opens the third valve 40, and the collection flow path 39 is opened by the third valve 40. That is, the liquid ejecting apparatus 11 pressurizes the inside of the second storage portion 35 by the pressurizing portion 47, and collects the liquid in the collection flow path 39 to the first storage portion 33. The operator replaces the liquid ejecting head 23 in a state where the liquid is drained from the supply flow path 37, the liquid ejecting head 23, and the collection flow path 39.

The effect of the present embodiment will be described.

(1) The communication passage 34 communicating with the first storage portion 33 and the supply flow path 37 communicating with the liquid ejecting head 23 are coupled to the second storage portion 35. The communication passage 34 can be closed by the first valve 36 when the pressurizing portion 47 pressurizes the inside of the second storage portion 35. Therefore, the pressurized liquid in the second storage portion 35 is supplied to the liquid ejecting head 23 via the supply flow path 37. Therefore, the liquid ejecting apparatus 11 can discharge the liquid from the nozzle 22 by pressurizing the liquid in the liquid ejecting head 23, and the possibility that the liquid ejecting head 23 draws the liquid from the nozzle 22 can be reduced.

(2) When the pressurizing portion 47 pressurizes the inside of the second storage portion 35 in a state where the first valve 36 closes the communication passage 34 and the second valve 38 closes the supply flow path 37, a pressurizing force is accumulated in the second storage portion 35. Therefore, by opening the second valve 38 in a state where the pressure in the second storage portion 35 is increased, a high pressure can be transmitted to the liquid ejecting head 23, and for example, a thickened liquid can be easily discharged.

(3) When the pressurizing portion 47 pressurizes the inside of the second storage portion 35 in a state where the third valve 40 closes the collection flow path 39, the liquid is discharged from the liquid ejecting head 23. When the pressurizing portion 47 pressurizes the inside of the second storage portion 35 in a state where the third valve 40 opens the collection flow path 39, the liquid in the liquid ejecting head 23 is collected in the first storage portion 33 via the collection flow path 39. Therefore, maintenance can be selected and performed according to, for example, the state of air bubbles in the supply flow path 37 and the state of the nozzle 22.

(4) When the pressurizing mechanism 57 pressurizes the liquid chamber 41 in a state where the third valve 40 closes the collection flow path 39, the liquid is discharged from the liquid ejecting head 23. The amount of liquid discharged at this time is determined by the size of the liquid chamber 41. Therefore, as compared with the case where the pressurizing portion 47 pressurizes the inside of the second storage portion 35, a slight pressurizing enough to break the meniscus formed in the nozzle 22 can be applied to the liquid ejecting head 23 with higher accuracy.

(5) The pressurizing mechanism 57 includes a pressurizing portion 47 that pressurizes the inside of the second storage portion 35. The pressurizing portion 47 pushes the flexible member 42 by pressurizing the air chamber 53 via the air flow path 55, and pressurizes the liquid chamber 41. Therefore, the pressurizing portion 47 can pressurize the liquid in the second storage portion 35 and the liquid in the liquid chamber 41.

(6) The first coupling portion 44 to which the collection flow path 39 is coupled is disposed at a position higher than the second coupling portion 45 to which the supply flow path 37 is coupled. Since the air bubbles in the liquid ejecting head 23 are likely to collect at a higher position due to buoyancy, they are more likely to collect at the first coupling portion 44 than at the second coupling portion 45. Therefore, by collecting the liquid in the liquid ejecting head 23 to the first storage portion 33 via the collection flow path 39, air bubbles can be easily discharged from the liquid ejecting head 23.

(7) For example, when the first valve 36 is driven to close the communication passage 34, a drive source for driving the first valve 36 is required. In that respect, the first valve 36 has a check valve. Specifically, the first valve 36 allows the flow of the liquid supplied from the first storage portion 33 to the second storage portion 35 due to the water head difference, but restricts the flow of the liquid from the second storage portion 35 to the first storage portion 33 when the inside of the second storage portion 35 is pressurized. Therefore, the first valve 36 does not need to be driven, and the drive source can be reduced.

(8) The nozzle surface 21 of the liquid ejecting head 23 is inclined with respect to the horizontal. Therefore, the degree of freedom in disposing the liquid ejecting head 23 can be improved.

(9) In the pressurization-discharge, the communication passage 34 is closed by the first valve 36, and the inside of the second storage portion 35 is pressurized by the pressurizing portion 47. The pressurized liquid in the second storage portion 35 is supplied to the liquid ejecting head 23 via the supply flow path 37. Therefore, the liquid ejecting apparatus 11 can discharge the liquid from the nozzle 22 by pressurizing the liquid in the liquid ejecting head 23, and the possibility that the liquid ejecting head 23 draws the liquid from the nozzle 22 can be reduced.

(10) In the accumulation-discharge, the pressurizing portion 47 pressurizes the inside of the second storage portion 35 in a state where the first valve 36 closes the communication passage 34 and the second valve 38 closes the supply flow path 37, so that the pressurizing force is accumulated in the second storage portion 35. In the accumulation-discharge, since the second valve 38 is opened after inside of the second storage portion 35 has been pressurized, the accumulated high pressure can be transmitted to the liquid ejecting head 23, and for example, a thickened liquid can be easily discharged.

(11) In the first accumulation-discharge, the supply flow path 37 is opened by the second valve 38 when the inside of the second storage portion 35 is pressurized with the first pressure, and the liquid is discharged from the nozzle 22. In the second accumulation-discharge, the supply flow path 37 is opened by the second valve 38 when the inside of the second storage portion 35 is pressurized with a second pressure lower than the first pressure, and the liquid is discharged from the nozzle 22. Therefore, for example, by combining the first accumulation-discharge and the second accumulation-discharge according to the configuration of the supply flow path 37, the supply flow path 37 can be efficiently filled with the liquid.

(12) When the pressurizing portion 47 is driven in a state where the communication passage 34 and the supply flow path 37 are closed, the longer the driving time, the higher the accumulated pressure. In that respect, in the first accumulation-discharge, the supply flow path 37 is opened by the second valve 38 after pressurizing the inside of the second storage portion 35 for the first time, and the liquid is discharged from the nozzle 22. In the second accumulation-discharge, the supply flow path 37 is opened by the second valve 38 after pressurizing the inside of the second storage portion 35 for the second time shorter than the first time, and the liquid is discharged from the nozzle 22. Therefore, for example, by combining the first accumulation-discharge and the second accumulation-discharge according to the configuration of the supply flow path 37, the supply flow path 37 can be efficiently filled with the liquid.

(13) When the liquid circulation is performed, the liquid is collected from the second storage portion 35 to the first storage portion 33 via the supply flow path 37, the liquid ejecting head 23, and the collection flow path 39. The air bubbles in the supply flow path 37 and the liquid ejecting head 23 move together with the liquid. Therefore, the air bubbles can be collected without discharging the liquid from the liquid ejecting head 23.

(14) In the slight pressurization-discharge, the pressurizing mechanism 57 pressurizes the flexible member 42 in a state where the second valve 38 closes the supply flow path 37 and the third valve 40 closes the collection flow path 39, so that the liquid in the liquid chamber 41 is pressurized, and the liquid is discharged from the liquid ejecting head 23. The amount of liquid discharged at this time is determined by the size of the liquid chamber 41. Therefore, as compared with the case where the pressurizing portion 47 pressurizes the inside of the second storage portion 35, a slight pressurizing enough to break the meniscus formed in the nozzle 22 can be applied to the liquid ejecting head 23 with higher accuracy.

(15) In the slight pressurization-discharge, the pressurizing portion 47 pressurizes the air chamber 53 via the air flow path 55, and pressurizes the flexible member 42. Therefore, the pressurizing portion 47 can pressurize the liquid in the second storage portion 35 and the liquid in the liquid chamber 41.

(16) In the head replacement routine, the communication passage 34 and the collection flow path 39 are closed, and the inside of the second storage portion 35 is pressurized in a state where the supply flow path 37 is opened, so that the liquid in the second storage portion 35, the supply flow path 37, and the liquid ejecting head 23 is discharged from the nozzle 22. After that, the inside of the second storage portion 35 is pressurized in a state where the communication passage 34 is closed and the collection flow path 39 and the supply flow path 37 are open, so that the liquid in the collection flow path 39 is collected in the first storage portion 33. Therefore, since the replacement of the liquid ejecting head 23 is performed in a state where the liquid is discharged from the supply flow path 37, the liquid ejecting head 23, and the collection flow path 39, it is possible to suppress the dripping of liquid from the supply flow path 37, the liquid ejecting head 23, and the collection flow path 39.

(17) In a case where the ejection flow rate when ejecting the liquid to the medium 12 is equal to or greater than the threshold value, the supply flow path 37 and the collection flow path 39 are opened. Since the liquid is supplied to the liquid ejecting head 23 not only from the supply flow path 37 but also from the collection flow path 39, the required amount of liquid can be easily supplied.

The present embodiment can be implemented by changing as follows. The present embodiment and the following modification examples can be implemented in combination with each other unless there is a technical contradiction.

The liquid ejecting apparatus 11 may include a wiping member (not illustrated) that wipes the nozzle surface 21. The liquid ejecting apparatus 11 may wipe the nozzle surface 21 with a wiping member after discharging the liquid from the nozzle 22. The liquid ejecting apparatus 11 may have the operator wipe the nozzle surface 21 before removing the liquid ejecting head 23.

The control portion 19 may control the opening and closing of the first valve 36. The control portion 19 may close the communication passage 34 by the first valve 36 before pressurizing the inside of the second storage portion 35.

In the second accumulation-discharge, after the inside of the second storage portion 35 has been pressurized for the first time in a state where the first valve 36 and the second valve 38 are closed to make the pressure in the second storage portion 35 the first pressure, the first valve 36 may be opened to reduce the pressure in the second storage portion 35 to the second pressure, and then the second valve 38 may be opened.

In the slight pressurization-discharge, the liquid in the liquid chamber 41 may be pressurized by pushing the flexible member 42 with the spring 54. In this case, the control portion 19 depressurizes the air chamber 53 to increase the volume of the liquid chamber 41, and then opens the air chamber 53 to the atmosphere. When the air chamber 53 reaches the atmospheric pressure, the spring 54 pushes the liquid in the liquid chamber 41 and discharges the liquid from the liquid ejecting head 23. In the case of the configuration in which the flexible member 42 is pushed by the spring 54, the spring 54 is included in the pressurizing mechanism 57.

The liquid ejecting apparatus 11 may perform printing in a state where the collection flow path 39 is opened by the third valve 40 regardless of the ejection flow rate.

The liquid ejecting head 23 may have a plurality of pressure chambers individually communicating with the plurality of nozzles 22, a common liquid chamber communicating with the plurality of pressure chambers, and a filter chamber in which the filter is housed. The first coupling portion 44 and the second coupling portion 45 are coupled to at least one of a pressure chamber, a common liquid chamber, and a filter chamber. For example, when the first coupling portion 44 and the second coupling portion 45 are coupled to the filter chamber, the liquid ejecting apparatus 11 can collect the air bubbles trapped in the filter together with the liquid in the first storage portion 33 by performing the liquid circulation. The liquid ejecting apparatus 11 may perform liquid circulation when air bubbles are generated in the liquid ejecting head 23.

The second valve 38 and the third valve 40 may be closed, and the supply flow path 37 and the collection flow path 39 may be closed when the liquid ejecting apparatus 11 is on standby and when the power is turned off. By closing the supply flow path 37 and the collection flow path 39, it is possible to reduce the possibility of liquid leaking from the liquid ejecting head 23 even when vibration or impact is applied to the liquid ejecting apparatus 11, for example.

The amount of liquid that can be stored in the second storage portion 35 may be less than the amount of liquid required for pressurization-discharge. In this case, the control portion 19 may alternately perform supply the liquid from the second storage portion 35 to the liquid ejecting head 23 by pressurizing the inside of the second storage portion 35, and supply the liquid from the first storage portion 33 to the second storage portion 35 by opening the second storage portion 35 to the atmosphere.

The liquid amount sensor 63 may detect that the first liquid level 66 is located at an end position below the standard position. When the liquid amount sensor 63 detects that the first liquid level 66 is located at the end position, the control portion 19 may notify that the first storage portion 33 is empty. For the end position, if the total amount of liquid stored in the first storage portion 33 and the second storage portion 35 when the first liquid level 66 and the second liquid level 70 are located at the end positions is used is larger than the amount of liquid required for printing on one medium 12, printing on one medium 12 can be completed.

The amount of liquid accommodated in the liquid accommodating portion 24 may be less than the amount of liquid that can be held by the supply mechanism 25. In this case, the liquid accommodating portion 24 may be replaced during the liquid filling in which the supply mechanism 25 is filled with the liquid.

For pressure accumulation-discharge, after the communication passage 34 is closed by the first valve 36 and the inside of the second storage portion 35 is pressurized in a state where the supply flow path 37 is closed by the second valve 38, when the pressure sensor 49 detects that the pressure has reached a predetermined pressure, the supply flow path 37 may be opened by the second valve 38. At this time, the control portion 19 may perform a first accumulation-discharge in which the supply flow path 37 is opened when the pressure sensor 49 detects that the pressure has reached a first pressure, and a second accumulation-discharge in which the supply flow path 37 is opened when the pressure sensor 49 detects that the pressure has reached a second pressure smaller than the first pressure. The first pressure and the second pressure are larger than a pressurizing force that pressurizes the second storage portion 35 at the time of pressurization-discharge.

The control portion 19 may depressurize the inside of the first storage portion 33 when the liquid flows into the first storage portion 33 from the collection flow path 39. For example, the atmosphere opening path 50 may be coupled to the air flow path 55. By driving the pressurizing portion 47 to rotate in the normal direction, the inside of the second storage portion 35 may be pressurized, and the inside of the first storage portion 33 may be depressurized via the air flow path 55 and the atmosphere opening path 50.

The control portion 19 may remove air bubbles from the liquid by depressurizing the inside of the first storage portion 33 and expanding the air bubbles contained in the liquid stored in the first storage portion 33.

Liquid filling, pressurization-discharge, slight pressurization-discharge, and liquid circulation may be performed a plurality of times or in combination. When the amount of liquid that can be stored in the first storage portion 33 is less than the amount of liquid that is filled in the supply flow path 37, the collection flow path 39, and the liquid ejecting head 23, the supply flow path 37, the collection flow path 39, and the liquid ejecting head 23 may be filled with the liquid by performing the liquid filling a plurality of times. For example, the slight pressurization-discharge may be performed after the liquid filling is performed. By combining liquid filling and slight pressurization-discharge, it is possible to reduce the occurrence of ejection failures as compared with the case where only liquid filling is performed.

The first storage portion 33 and the second storage portion 35 may be integrally configured.

The flexible member 42 may be formed of a rubber film, an elastomer film, a film, or the like.

The liquid chamber 41 may be provided in the supply flow path 37. The pressurizing mechanism 57 may pressurize the liquid chamber provided in the supply flow path 37.

The pressurizing portion 47 may use a diaphragm pump, a piston pump, a gear pump, or the like.

The introduction portion 60 and the flowing-out portion 30 may have a plurality of flow paths. For example, one flow path may allow a liquid to flow from the liquid accommodating portion 24 into the first storage portion 33, and the other flow path may allow air to flow from the first storage portion 33 into the liquid accommodating portion 24.

The liquid ejecting head 23 may eject the liquid in a horizontal posture in which the nozzle surface 21 is horizontal and perform printing on the medium 12. The liquid ejecting head 23 may be provided so that the posture can be changed between a horizontal posture and an inclined posture.

The liquid ejecting apparatus 11 may be provided with an atmosphere opening path for opening the second storage portion 35 to the atmosphere separately from the pressurization flow path 51.

In the head replacement routine illustrated in FIG. 9, the control portion 19 may perform steps S702 to S705 again after performing step S710. As a result, the liquid collected in the first storage portion 33 can be discharged from the liquid ejecting head 23.

Second Embodiment

Hereinafter, a liquid ejecting apparatus and a control method of the liquid ejecting apparatus according to a second embodiment will be described with reference to the drawings. The liquid ejecting apparatus is an ink jet printer which ejects ink, which is an example of a liquid, to perform printing on a medium such as a paper sheet.

In the drawing, the direction of gravity is indicated by a Z axis, and the directions along the horizontal plane are indicated by an X axis and a Y axis, assuming that a liquid ejecting apparatus 111 is placed on the horizontal plane. The X axis, the Y axis, and the Z axis are orthogonal to one another.

Figure 10:
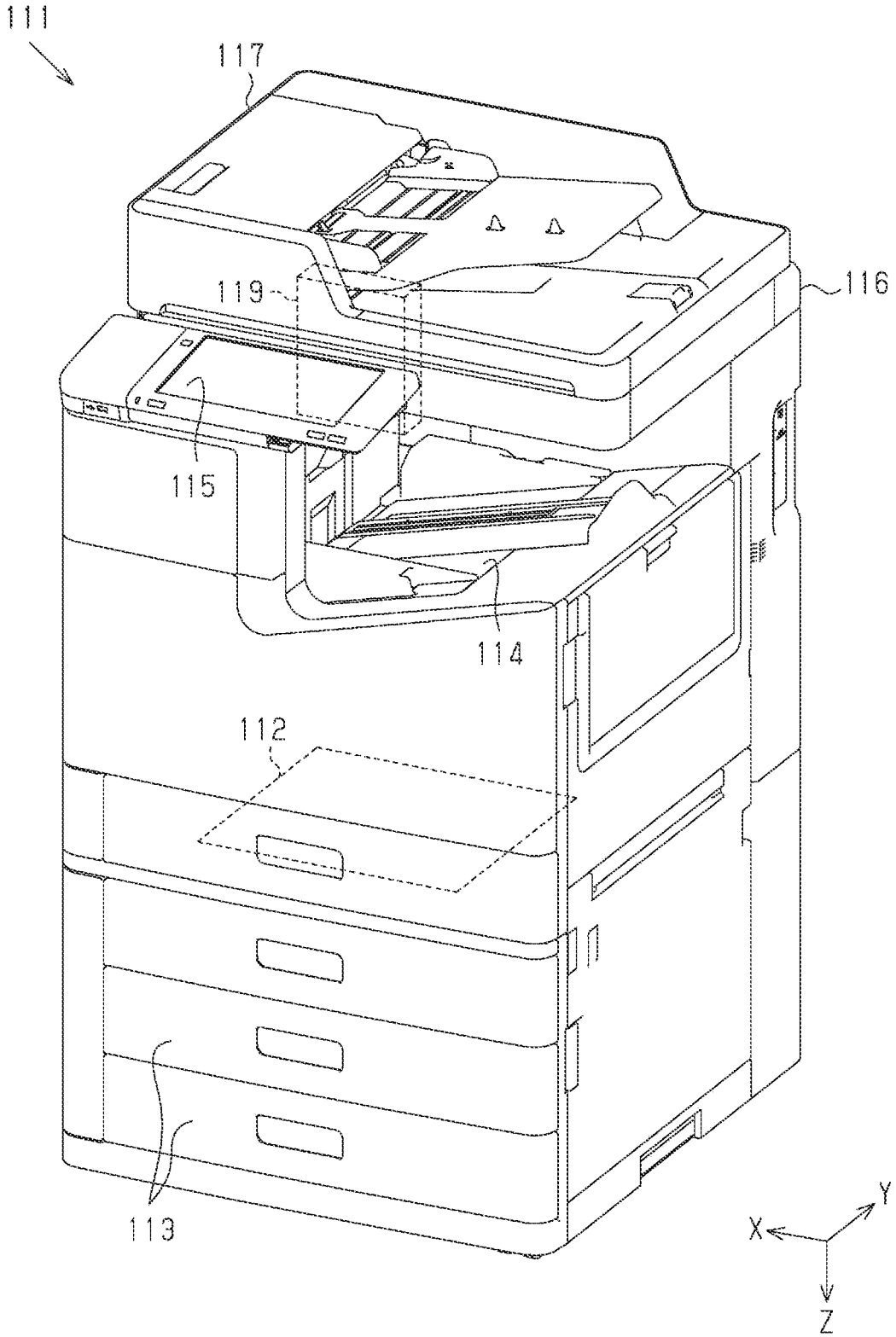
FIG. 10 is a perspective view of a liquid ejecting apparatus according to a second embodiment.

As illustrated in FIG. 10, the liquid ejecting apparatus 111 may include a medium accommodating portion 113 capable of accommodating a medium 112, a stacker 114 for receiving the printed medium 112, and an operation portion 115 such as a touch panel for operating the liquid ejecting apparatus 111. The liquid ejecting apparatus 111 may include an image reading portion 116 that reads an image of an original document and an automatic feeding portion 117 that sends the original document to the image reading portion 116.

The liquid ejecting apparatus 111 includes a control portion 119 that controls various operations performed by the liquid ejecting apparatus 111. The control portion 119 is composed of, for example, a computer, a processing circuit including a memory, and the like, and performs control according to a program stored in the memory.

Figure 11:
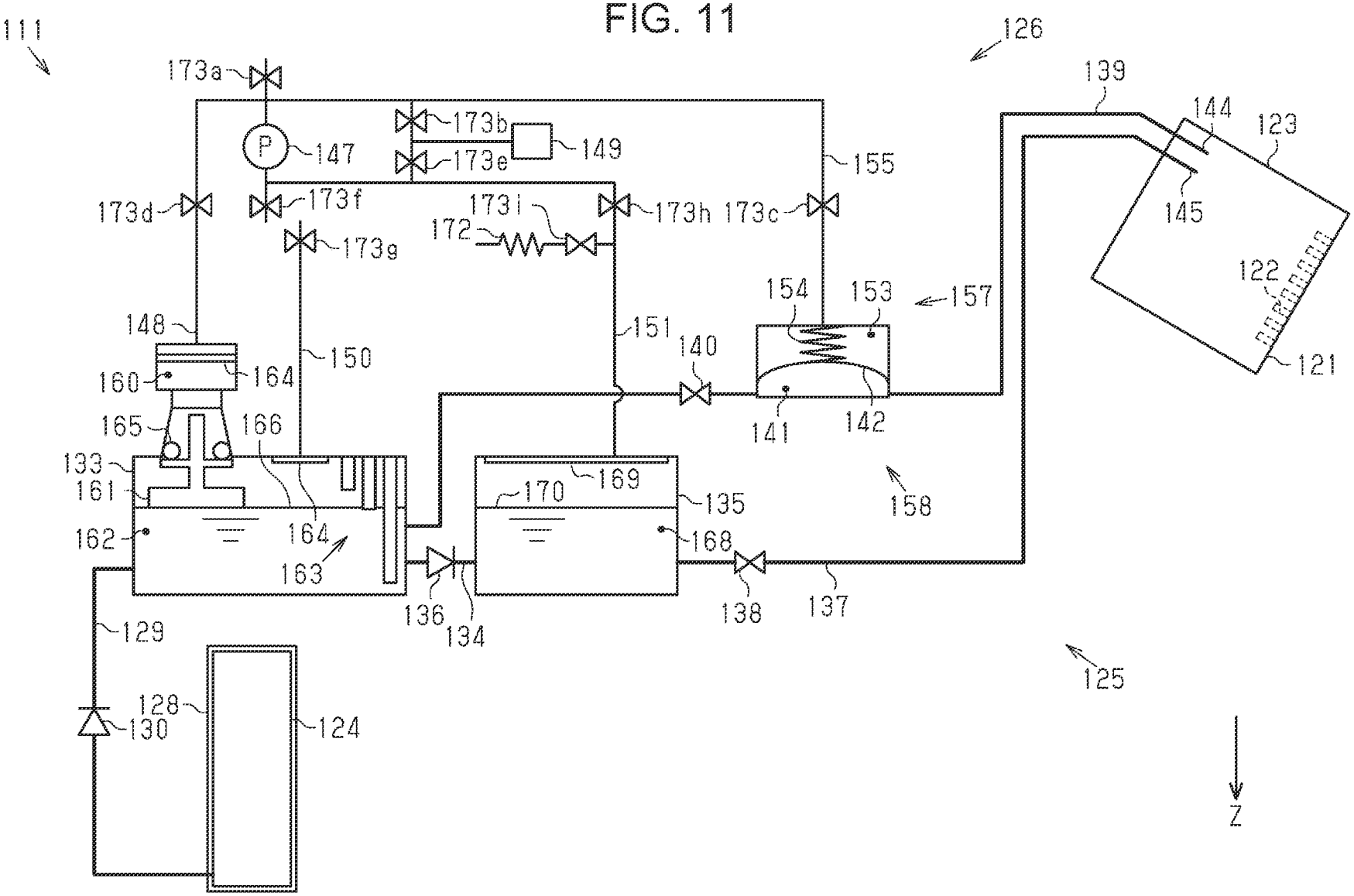
FIG. 11 is a schematic diagram of a supply mechanism and a drive mechanism included in the liquid ejecting apparatus according to the second embodiment.

As illustrated in FIG. 11, the liquid ejecting apparatus 111 includes a liquid ejecting head 123 for ejecting the liquid from a nozzle 122 provided on a nozzle surface 121 and a supply mechanism 125 for supplying the liquid accommodated in a liquid accommodating portion 124 to the liquid ejecting head 123, and a drive mechanism 126 for driving the supply mechanism 125. The liquid ejecting apparatus 111 may include a plurality of supply mechanisms 125. The plurality of supply mechanisms 125 may supply different types of liquids to the liquid ejecting head 123. For example, the liquid ejecting apparatus 111 may eject a plurality of colors of ink supplied by the plurality of supply mechanisms 125 to perform color printing. One drive mechanism 126 may drive a plurality of supply mechanisms 125 together. The liquid ejecting apparatus 111 may include a plurality of drive mechanisms 126 that individually drive the plurality of supply mechanisms 125.

The liquid ejecting head 123 may be provided detachably from the main body of the liquid ejecting apparatus 111. The liquid ejecting head 123 is disposed so that the nozzle surface 121 is inclined with respect to the horizontal in an inclined posture. The liquid ejecting head 123 may eject the liquid to the medium 112 in an inclined posture to perform printing. The liquid ejecting head 123 of the present embodiment is a line type provided over a width direction of the medium 112. The liquid ejecting head 123 may be configured as a serial type that performs printing while moving in the width direction of the medium 112.

The supply mechanism 125 may include a mounting portion 128 to which the liquid accommodating portion 124 is detachably mounted, an introduction flow path 129 into which liquid can be introduced from the liquid accommodating portion 124 mounted on the mounting portion 128, and an introduction valve 130 capable of opening and closing the introduction flow path 129. The liquid accommodating portion 124 before being mounted on the mounting portion 128 may accommodate a larger amount of liquid than the amount of liquid that the supply mechanism 125 can hold. The liquid accommodating portion 124 is coupled to the upstream end of the introduction flow path 129 by being mounted on the mounting portion 128. The introduction valve 130 may be configured to have a check valve that allows the flow of the liquid from the liquid accommodating portion 124 to the first storage portion 133 and restricts the flow of the liquid from the first storage portion 133 to the liquid accommodating portion 124.

The supply mechanism 125 includes a first storage portion 133 that stores the liquid supplied from the liquid accommodating portion 124 that accommodates the liquid, a communication passage 134 of which an upstream end is coupled to the first storage portion 133, and a second storage portion 135 to which a downstream end of the communication passage 134 is coupled. The first storage portion 133 of the present embodiment is coupled to the downstream end of the introduction flow path 129 and communicates with the liquid accommodating portion 124 via the introduction flow path 129. The second storage portion 135 communicates with the first storage portion 133 via the communication passage 134. The supply mechanism 125 includes a first valve 136 capable of opening and closing the communication passage 134, and a supply flow path 137 for supplying liquid from the second storage portion 135 to the liquid ejecting head 123. The supply mechanism 125 may include a second valve 138 provided in the supply flow path 137 between the second storage portion 135 and the liquid ejecting head 123, a collection flow path 139 for collecting the liquid from the liquid ejecting head 123 to the first storage portion 133, a third valve 140 capable of opening and closing the collection flow path 139, and a liquid chamber 141 provided in the collection flow path 139.

The liquid chamber 141 is provided in the collection flow path 139 between the liquid ejecting head 123 and the third valve 140. The liquid chamber 141 is partially composed of a flexible member 142, and the volume of the liquid chamber 141 changes as the flexible member 142 is deformed.

The liquid ejecting head 123 may have a first coupling portion 144 to which the collection flow path 139 is coupled and a second coupling portion 145 to which the supply flow path 137 is coupled. An upstream end of the collection flow path 139 is coupled to the first coupling portion 144, and a downstream end thereof is coupled to the first storage portion 133. An upstream end of the supply flow path 137 is coupled to the second storage portion 135, and a downstream end thereof is coupled to the second coupling portion 145. In the inclined posture, the first coupling portion 144 between the liquid ejecting head 123 and the collection flow path 139 may be disposed at a position higher than the second coupling portion 145 between the liquid ejecting head 123 and the supply flow path 137.

The drive mechanism 126 includes a variable pressure mechanism 147 that depressurizes the inside of the first storage portion 133 and pressurizes the inside of the second storage portion 135. The drive mechanism 126 may include a depressurization flow path 148 through which the inside of the first storage portion 133 communicates with the variable pressure mechanism 147, and a pressure sensor 149 capable of detecting the pressure in the depressurization flow path 148. The drive mechanism 126 may include an atmosphere opening path 150 coupled to the first storage portion 133 and a pressurization flow path 151 through which the inside of the second storage portion 135 communicates with the variable pressure mechanism 147.

The drive mechanism 126 may include an air chamber 153 separated from the liquid chamber 141 via the flexible member 142, a spring 154 provided in the air chamber 153, and an air flow path 155 coupled to the air chamber 153. By pushing the flexible member 142, the spring 154 reduces the pressure fluctuation of the liquid in the collection flow path 139 and the liquid ejecting head 123.

The variable pressure mechanism 147 is, for example, a tube pump that sends the air by rotating the roller while crushing the tube. A tube (not illustrated) included in the variable pressure mechanism 147 has the depressurization flow path 148 and the air flow path 155 coupled to one end and the pressurization flow path 151 coupled to the other end. The variable pressure mechanism 147 is driven to rotate in the normal direction to send the air taken in from the depressurization flow path 148 and the air flow path 155 to the pressurization flow path 151. The variable pressure mechanism 147 is driven to rotate in the reverse direction to send the air taken in from the pressurization flow path 151 to the depressurization flow path 148 and the air flow path 155.

In the present embodiment, the variable pressure mechanism 147, the air chamber 153, and the air flow path 155 through which the variable pressure mechanism 147 communicates with the air chamber 153 are included to form a pressurizing mechanism 157, the liquid chamber 141 is added to the pressurizing mechanism 157 to form a slight pressurizing portion 158. The slight pressurizing portion 158 has the liquid chamber 141 and the pressurizing mechanism 157 capable of pressurizing the flexible member 142 from the outside of the liquid chamber 141. The slight pressurizing portion 158 is provided in the collection flow path 139 between the liquid ejecting head 123 and the third valve 140, and pressurizes the liquid in the collection flow path 139.

Next, the first storage portion 133 will be described.

The first storage portion 133 may have a depressurization chamber 160 to which the depressurization flow path 148 is coupled, and a float valve 161 capable of opening and closing the depressurization flow path 148. The first storage portion 133 may have a first storage chamber 162 for storing liquid, a liquid amount sensor 163 for detecting the amount of liquid stored in the first storage chamber 162, and a first gas-liquid separation membrane 164 for separating the first storage chamber 162 and the drive mechanism 126 from each other. The first gas-liquid separation membrane 164 is a membrane having a property of allowing a gas to pass therethrough and preventing a liquid from passing therethrough. For example, the first gas-liquid separation membrane 164 may be provided in the first storage chamber 162 so as to separate the first storage chamber 162 and the atmosphere opening path 150 from each other. The first gas-liquid separation membrane 164 may be provided in the depressurization chamber 160 so as to separate the first storage chamber 162 and the depressurization flow path 148 from each other. The first storage portion 133 may include a seal member 165 capable of sealing between the depressurization chamber 160 and the float valve 161.

The float valve 161 moves following the movement of a first liquid level 166 in the first storage portion 133. The float valve 161 contacts the seal member 165 when the height of the first liquid level 166 reaches a predetermined height, and closes the depressurization chamber 160. That is, the float valve 161 of the present embodiment closes the depressurization flow path 148 by separating the depressurization chamber 160 and the first storage chamber 162 from each other.

In the present embodiment, the position of the first liquid level 166 when the float valve 161 closes the depressurization flow path 148 is referred to as a standard position. The standard position is a position lower than the nozzle surface 121. The first liquid level 166 fluctuates in a range lower than that of the nozzle surface 121.

Specifically, when the first liquid level 166 is located below the standard position, the float valve 161 is separated from the seal member 165, and the first storage chamber 162 communicates with the depressurization chamber 160. When the variable pressure mechanism 147 depressurizes the inside of the depressurization chamber 160, the inside of the first storage portion 133 is also depressurized, and the liquid is supplied from the liquid accommodating portion 124 to the first storage portion 133. The first liquid level 166 rises by the amount of the supplied liquid. When the first liquid level 166 reaches the standard position, the float valve 161 closes the depressurization flow path 148. As a result, the depressurization in the first storage chamber 162 is stopped, and the inflow of the liquid from the liquid accommodating portion 124 to the first storage portion 133 is stopped.

The first liquid level 166 is lowered by supplying a liquid from the first storage portion 133 to the second storage portion 135. When the first liquid level 166 is lowered and the float valve 161 communicates the depressurization chamber 160 with the first storage chamber 162, the liquid is supplied from the liquid accommodating portion 124 to the first storage portion 133. Therefore, the first liquid level 166 moves below the standard position.

When the liquid accommodated in the liquid accommodating portion 124 runs out, the first liquid level 166 cannot rise to the standard position. The liquid amount sensor 163 may detect that the first liquid level 166 is located at the standard position, the first liquid level 166 is located at a replenishment position below the standard position, and the first liquid level 166 is located at the full position above the standard position. When the first liquid level 166 is located at the full position, the first storage portion 133 stores the maximum amount of liquid. The replenishment position is a position that serves as a guide for replenishing the liquid from the liquid accommodating portion 124 to the first storage portion 133. When the first liquid level 166 does not rise to the standard position even if the pressure in the first storage portion 133 is reduced, the control portion 119 may determine that the liquid accommodating portion 124 is empty and instruct the user to replace the liquid accommodating portion 124 or to replenish the liquid accommodating portion 124 with the liquid.

The standard position of the present embodiment is located above the position where the downstream end of the collection flow path 139 is coupled in the first storage chamber 162. Therefore, when the first liquid level 166 is in the standard position, the liquid in the first storage portion 133 can be supplied to the liquid ejecting head 123 via the collection flow path 139.

Next, the second storage portion 135 will be described.

The second storage portion 135 may have a second storage chamber 168 for storing the liquid and a second gas-liquid separation membrane 169 for separating the second storage chamber 168 and the pressurization flow path 151. Like the first gas-liquid separation membrane 164, the second gas-liquid separation membrane 169 is a membrane having a property of allowing a gas to pass therethrough and preventing a liquid from passing therethrough.

To the second storage portion 135, the liquid is supplied from the first storage portion 133 due to a water head difference. The first valve 136 may be configured to have a check valve that allows the flow of the liquid from the first storage portion 133 to the second storage portion 135 and restricts the flow of the liquid from the second storage portion 135 to the first storage portion 133. When the inside of the first storage chamber 162 and the inside of the second storage chamber 168 are at atmospheric pressure, a second liquid level 170 of the liquid in the second storage portion 135 becomes the same height as the first liquid level 166. In other words, the second liquid level 170 fluctuates in a range lower than that of the nozzle surface 121. The liquid in the liquid ejecting head 123 is maintained at a negative pressure due to the water head difference between the liquid in the first storage portion 133 and the liquid in the second storage portion 135. When the liquid is consumed by the liquid ejecting head 123, the liquid stored in the second storage portion 135 is supplied to the liquid ejecting head 123.

The first valve 136 closes the communication passage 134 when the pressure in the second storage portion 135 is higher than the pressure in the first storage portion 133. Therefore, the first valve 136 closes the communication passage 134 when the variable pressure mechanism 147 pressurizes the inside of the second storage portion 135. The first valve 136 closes the communication passage 134 when the variable pressure mechanism 147 depressurizes the inside of the first storage portion 133. The opening and closing of the second valve 138 and the third valve 140 are controlled by the control portion 119. The second valve 138 is provided so that the supply flow path 137 can be opened and closed during the pressurization by the variable pressure mechanism 147.

The drive mechanism 126 includes a thin tube portion 172 provided by being branched from the pressurization flow path 151, and first selection valves 173*a* to ninth selection valves 173*i* capable of opening and closing the flow path.

The thin tube portion 172 is a thin and meandering tube to the extent that the flow of the liquid is greatly restricted with respect to the flow of air.

The first selection valve 173*a* communicates the depressurization flow path 148 and the air flow path 155 with the atmosphere by opening the valve. The second selection valve 173*b* communicates the depressurization flow path 148 and the air flow path 155 with the pressure sensor 149 by opening the valve. The third selection valve 173*c* opens the air flow path 155, and communicates the variable pressure mechanism 147 with the air chamber 153 by opening the valve.

The fourth selection valve 173*d* opens the depressurization flow path 148, and communicates the variable pressure mechanism 147 with the depressurization chamber 160 by opening the valve. The fifth selection valve 173*e* communicates the pressurization flow path 151 with the pressure sensor 149 by opening the valve. The sixth selection valve 173*f* communicates the pressurization flow path 151 with the atmosphere by opening the valve. The seventh selection valve 173*g* opens the atmosphere opening path 150 and communicates the first storage chamber 162 with the atmosphere by opening the valve. The eighth selection valve 173*h* opens the pressurization flow path 151, and communicates the variable pressure mechanism 147 with the second storage chamber 168 by opening the valve. The ninth selection valve 173*i* communicates the pressurization flow path 151 with the thin tube portion 172, and communicates the pressurization flow path 151 with the atmosphere via the thin tube portion 172 by opening the valve.

When the pressure in the air chamber 153 is changed, the drive mechanism 126 opens the second selection valve 173*b*, the third selection valve 173*c*, and the sixth selection valve 173*f* and closes the other selection valves. In this state, when the variable pressure mechanism 147 is driven to rotate in the normal direction, the air in the air chamber 153 is discharged via the air flow path 155 and the pressurization flow path 151, and the pressure in the air chamber 153 decreases. In this state, when the variable pressure mechanism 147 is driven to rotate in the reverse direction, air is sent to the air chamber 153 via the pressurization flow path 151 and the air flow path 155, and the pressure in the air chamber 153 rises. At this time, the pressure sensor 149 may detect the pressure in the air flow path 155 and the air chamber 153. The control portion 119 may control the drive of the variable pressure mechanism 147 based on the detection result of the pressure sensor 149.

When the first storage portion 133 is opened to the atmosphere, the drive mechanism 126 opens the seventh selection valve 173*g* and stops driving the variable pressure mechanism 147. The first storage chamber 162 communicates with the atmosphere via the atmosphere opening path 150, and becomes atmospheric pressure.

When the inside of the first storage portion 133 is depressurized, the drive mechanism 126 opens the second selection valve 173*b*, the fourth selection valve 173*d*, and the sixth selection valve 173*f* and closes the other selection valves. In this state, when the variable pressure mechanism 147 is driven to rotate in the normal direction, the air in the depressurization chamber 160 is discharged via the depressurization flow path 148 and the pressurization flow path 151, and the pressure in the depressurization chamber 160 decreases. At this time, the pressure sensor 149 may detect the pressure in the depressurization flow path 148 and the depressurization chamber 160. The control portion 119 may control the drive of the variable pressure mechanism 147 based on the detection result of the pressure sensor 149.

When the second storage portion 135 is opened to the atmosphere, the drive mechanism 126 opens the ninth selection valve 173*i* and stops driving the variable pressure mechanism 147. The second storage chamber 168 communicates with the atmosphere via the pressurization flow path 151 and the thin tube portion 172, and becomes atmospheric pressure.

When the inside of the second storage portion 135 is pressurized, the drive mechanism 126 opens the first selection valve 173*a*, the fifth selection valve 173*e*, and the eighth selection valve 173*h* and closes the other selection valves. In this state, when the variable pressure mechanism 147 is driven to rotate in the normal direction, air flows into the second storage chamber 168 via the pressurization flow path 151, and the pressure in the second storage chamber 168 rises. At this time, the pressure sensor 149 may detect the pressure in the pressurization flow path 151 and the second storage chamber 168. The control portion 119 may control the drive of the variable pressure mechanism 147 based on the detection result of the pressure sensor 149.

Next, a control method of the liquid ejecting apparatus 111 will be described with reference to the flowcharts illustrated in FIGS. 12 to 18. Here, the step order of each control method can be optionally replaced within a range that does not deviate from the purpose of each control method.

Figure 12:
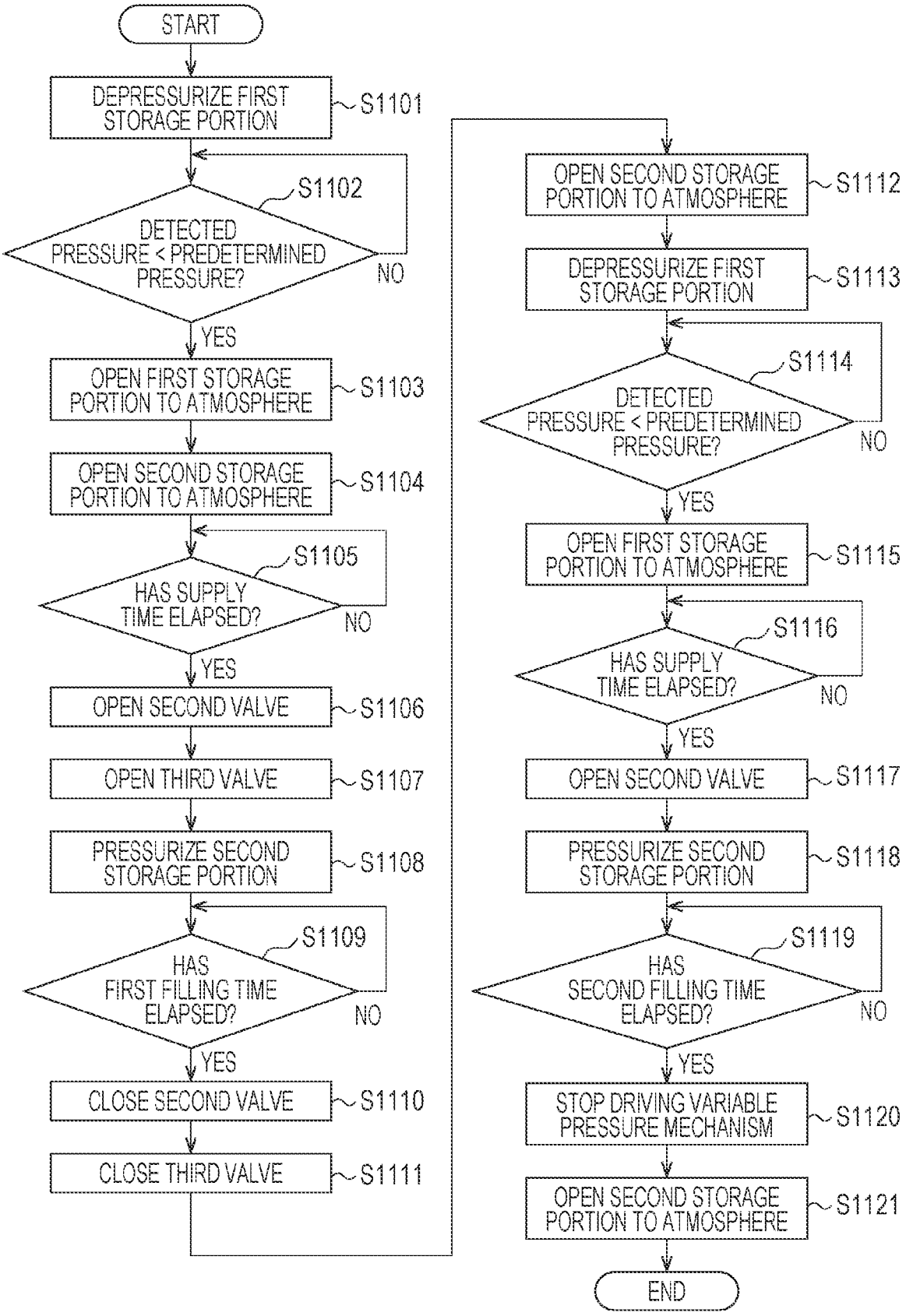
FIG. 12 is a flowchart illustrating an entire filling routine of the second embodiment.

The entire filling routine illustrated in FIG. 12 may be performed at the timing when the liquid accommodating portion 124 is first mounted on the mounting portion 128. The entire filling routine may be performed at the timing when the liquid accommodating portion 124 is mounted on the mounting portion 128 after the liquid ejecting head 123 is replaced. In the initial state, the second valve 138, the third valve 140, and all the selection valves are closed.

In step S1101, the control portion 119 depressurizes the inside of the first storage portion 133. In step S1102, the control portion 119 determines whether or not the pressure detected by the pressure sensor 149 has fallen below the predetermined pressure. The predetermined pressure is a negative pressure, which is larger than the negative pressure that allows the liquid to flow from the liquid accommodating portion 124 into the first storage portion 133 and raises the first liquid level 166. When the pressure detected by the pressure sensor 149 is equal to or higher than the predetermined pressure, step S1102 becomes NO, and the control portion 119 waits until the detected pressure falls below the predetermined pressure. When the detected pressure falls below the predetermined pressure, step S1102 becomes YES, and the control portion 119 shifts the process to step S1103.

In step S1103, the control portion 119 opens the first storage portion 133 to the atmosphere. In step S1104, the control portion 119 opens the second storage portion 135 to the atmosphere. In step S1105, the control portion 119 determines whether or not a supply time has elapsed after the first storage portion 133 and the second storage portion 135 have been opened to the atmosphere. The supply time is a time required for the liquid to be supplied from the first storage portion 133 to the second storage portion 135 so that the heights of the first liquid level 166 and the second liquid level 170 are aligned. When the supply time has not elapsed, step S1105 becomes NO, and the control portion 119 waits until the supply time elapses. When the supply time elapses, step S1105 becomes YES, and the control portion 119 shifts the process to step S1106. Here, step S1103 and step S1104 may be performed at the same time or step S1103 may be performed after step S1104.

In step S1106, the control portion 119 opens the second valve 138. In step S1107, the control portion 119 opens the third valve 140. In step S1108, the control portion 119 pressurizes the inside of the second storage portion 135. Here, step S1106 and step S1107 each may be performed at the same time as step S1108 or after step S1108.

In step S1109, the control portion 119 determines whether or not a first filling time has elapsed after the inside of the second storage portion 135 has been pressurized. The first filling time is a time required to fill the supply flow path 137 and the collection flow path 139 with the liquid in the second storage portion 135. When the first filling time has not elapsed, step S1109 becomes NO, and the control portion 119 waits until the first filling time elapses. When the first filling time elapses, step S1109 becomes YES, and the control portion 119 shifts the process to step S1110.

In step S1110, the control portion 119 closes the second valve 138. In step S1111, the control portion 119 closes the third valve 140. In step S1112, the control portion 119 opens the second storage portion 135 to the atmosphere. In step S1113, the control portion 119 depressurizes the inside of the first storage portion 133. In step S1114, the control portion 119 determines whether or not the pressure detected by the pressure sensor 149 has fallen below the predetermined pressure. When the pressure detected by the pressure sensor 149 is equal to or higher than the predetermined pressure, step S1114 becomes NO, and the control portion 119 waits until the detected pressure falls below the predetermined pressure. When the detected pressure falls below the predetermined pressure, step S1114 becomes YES, and the control portion 119 shifts the process to step S1115. Here, step S1110 and step S1111 each may be performed at the same time as step S1112 or after step S1112.

In step S1115, the control portion 119 opens the first storage portion 133 to the atmosphere. In step S1116, the control portion 119 determines whether or not a supply time has elapsed after the first storage portion 133 has been opened to the atmosphere. When the supply time has not elapsed, step S1116 becomes NO, and the control portion 119 waits until the supply time elapses. When the supply time elapses, step S1116 becomes YES, and the control portion 119 shifts the process to step S1117.

In step S1117, the control portion 119 opens the second valve 138. In step S1118, the control portion 119 pressurizes the inside of the second storage portion 135. In step S1119, the control portion 119 determines whether or not a second filling time has elapsed after the inside of the second storage portion 135 has been pressurized. The second filling time is the time required to fill the liquid from the supply flow path 137 to the nozzle 122. When the second filling time has not elapsed, step S1119 becomes NO, and the control portion 119 waits until the second filling time elapses. When the second filling time elapses, step S1119 becomes YES, and the control portion 119 shifts the process to step S1120. Here, step S1117 may be performed at the same time as step S1118 or after step S1118.

In step S1120, the control portion 119 stops driving the variable pressure mechanism 147. In step S1121, the control portion 119 opens the second storage portion 135 to the atmosphere and ends the entire filling routine. Here, step S1120 may be performed at the same time as step S1121 or after step S1121.

Next, the operation when entire filling is performed will be described.

As illustrated in FIG. 11, the liquid ejecting apparatus 111 depressurizes the inside of the first storage portion 133 by the variable pressure mechanism 147, and supplies the liquid from the liquid accommodating portion 124 to the first storage portion 133. At this time, the pressure of the first storage portion 133 becomes lower than the pressure of the second storage portion 135. Therefore, the first valve 136 is closed. That is, the liquid ejecting apparatus 111 depressurizes the inside of the first storage portion 133, so that the communication passage 134 is closed by the first valve 136.

When the inside of the first storage portion 133 is depressurized, the liquid is supplied from the liquid accommodating portion 124 to the first storage portion 133, and the first liquid level 166 rises. Since the communication passage 134 is closed, no liquid is supplied to the second storage portion 135.

When the first liquid level 166 rises to the standard position, the float valve 161 separates the depressurization chamber 160 and the first storage chamber 162. In the first storage chamber 162, the depressurization is stopped and the inflow of the liquid into the first storage portion 133 is stopped. The pressure of the depressurization chamber 160 closed by the float valve 161 is further reduced. When the pressure detected by the pressure sensor 149 falls below a predetermined pressure, the control portion 119 stops driving the variable pressure mechanism 147 and opens the first storage portion 133 and the second storage portion 135 to the atmosphere.

When the first storage portion 133 and the second storage portion 135 are opened to the atmosphere, the first valve 136 is opened, and the communication passage 134 is opened. Specifically, the liquid ejecting apparatus 111 opens the communication passage 134 by the first valve 136, releases the depressurization in the first storage portion 133 by the variable pressure mechanism 147, and supplies the liquid from the first storage portion 133 to the second storage portion 135 by the water head difference. The first liquid level 166 is lowered by the amount of the liquid supplied to the second storage portion 135. The second liquid level 170 rises by the amount of the liquid supplied from the first storage portion 133. When the heights of the first liquid level 166 and the second liquid level 170 are aligned, the flow of the liquid from the first storage portion 133 to the second storage portion 135 is stopped.

The liquid ejecting apparatus 111 opens the second valve 138, and the supply flow path 137 is opened by the second valve 138. The liquid ejecting apparatus 111 opens the third valve 140, and the collection flow path 139 is opened by the third valve 140. The liquid ejecting apparatus 111 pressurizes the inside of the second storage portion 135 by the variable pressure mechanism 147. At this time, since the pressure of the second storage portion 135 becomes higher than the pressure of the first storage portion 133, the first valve 136 is closed. That is, the liquid ejecting apparatus 111 pressurizes the second storage portion 135, so that the communication passage 134 is closed by the first valve 136. The liquid in the second storage portion 135 flows into the first storage portion 133 via the supply flow path 137, the liquid ejecting head 123, and the collection flow path 139. In other words, the liquid ejecting apparatus 111 fills the supply flow path 137 and the collection flow path 139 with the liquid in the second storage portion 135.

Subsequently, the liquid ejecting apparatus 111 closes the second valve 138, and the supply flow path 137 is closed by the second valve 138. The liquid ejecting apparatus 111 closes the third valve 140, and the collection flow path 139 is closed by the third valve 140. The liquid ejecting apparatus 111 opens the second storage portion 135 to the atmosphere.

The liquid ejecting apparatus 111 depressurizes the inside of the first storage portion 133 by the variable pressure mechanism 147, and supplies the liquid from the liquid accommodating portion 124 to the first storage portion 133. At this time, since the pressure of the first storage portion 133 becomes lower than the pressure of the second storage portion 135, the first valve 136 is closed. That is, the liquid ejecting apparatus 111 depressurizes the inside of the first storage portion 133, so that the communication passage 134 is closed by the first valve 136.

When the inside of the first storage portion 133 is depressurized, the liquid is supplied from the liquid accommodating portion 124 to the first storage portion 133, and the first liquid level 166 rises. Since the communication passage 134 is closed, no liquid is supplied to the second storage portion 135. When the first liquid level 166 rises to the standard position and the pressure detected by the pressure sensor 149 falls below a predetermined pressure, the control portion 119 stops driving the variable pressure mechanism 147 and opens the first storage portion 133 to the atmosphere.

Since the second storage portion 135 is opened to the atmosphere first, when the first storage portion 133 is opened to the atmosphere, the first valve 136 is opened, and the communication passage 134 is opened. The liquid ejecting apparatus 111 opens the communication passage 134 by the first valve 136, releases the depressurization in the first storage portion 133 by the variable pressure mechanism 147, and supplies the liquid from the first storage portion 133 to the second storage portion 135 by the water head difference. When the heights of the first liquid level 166 and the second liquid level 170 are aligned, the liquid ejecting apparatus 111 opens the second valve 138, and the supply flow path 137 is opened. At this time, the third valve 140 is closed and the collection flow path 139 is closed.

The liquid ejecting apparatus 111 pressurizes the inside of the second storage portion 135 by the variable pressure mechanism 147 in a state where the collection flow path 139 is closed by the third valve 140. The liquid ejecting apparatus 111 closes the communication passage 134 again by the first valve 136 by making the pressure in the second storage portion 135 higher than the pressure in the first storage portion 133. Since the collection flow path 139 is closed, the liquid in the second storage portion 135 is supplied to the liquid ejecting head 123 via the supply flow path 137 and discharged from the nozzle 122. The liquid ejecting apparatus 111 fills the nozzle 122 of the liquid ejecting head 123 with the liquid in the second storage portion 135.

When the liquid ejecting head 123 is filled with the liquid, the liquid ejecting apparatus 111 may stop driving the variable pressure mechanism 147 and open the second storage portion 135 to the atmosphere. As a result, the first valve 136 is opened and opens the communication passage 134. The liquid in the first storage portion 133 is supplied to the second storage portion 135 via the communication passage 134. The liquid ejecting apparatus 111 may close the second valve 138.

Figure 13:
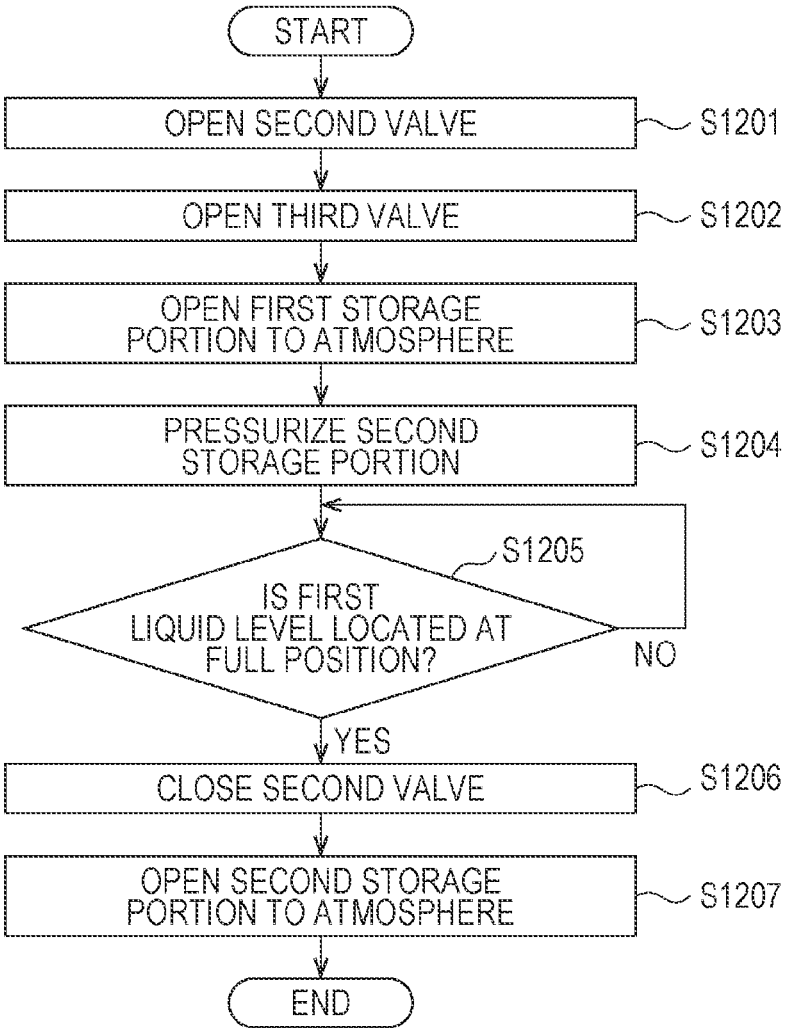
FIG. 13 is a flowchart illustrating a liquid circulation routine of the second embodiment.

The liquid circulation routine illustrated in FIG. 13 may be performed at the timing instructed to perform the liquid circulation. The liquid circulation is instructed to be performed, for example, after the entire filling is performed and during the waiting time when printing or the like is not performed. The control portion 119 may periodically perform the liquid circulation routine.

In step S1201, the control portion 119 opens the second valve 138. In step S1202, the control portion 119 opens the third valve 140. In step S1203, the control portion 119 opens the first storage portion 133 to the atmosphere. In step S1204, the control portion 119 pressurizes the inside of the second storage portion 135. Here, steps S1201 to S1204 may be performed at the same time, or the order may be changed.

In step S1205, the control portion 119 determines whether or not the first liquid level 166 is located at the full position. When the first liquid level 166 is not located at the full position, step S1205 becomes NO, and the control portion 119 waits until the first liquid level 166 is located at the full position. When the first liquid level 166 is located at the full position, step S1205 becomes YES, and the control portion 119 shifts the process to step S1206. In step S1206, the control portion 119 closes the second valve 138. In step S1207, the control portion 119 opens the second storage portion 135 to the atmosphere and ends the liquid circulation routine. Here, step S1206 may be performed at the same time as step S1207 or may be performed after step S1207.

Next, the operation when the liquid circulation is performed will be described.

As illustrated in FIG. 11, the control portion 119 opens the second valve 138 and the supply flow path 137 is opened by the second valve 138. The control portion 119 opens the third valve 140, and the collection flow path 139 is opened by the third valve 140.

The liquid ejecting apparatus 111 pressurizes the inside of the second storage portion 135 by the variable pressure mechanism 147, so that the liquid flows from the second storage portion 135 to the first storage portion 133 via the liquid ejecting head 123. At this time, the pressure of the second storage portion 135 becomes higher than the pressure of the first storage portion 133. Therefore, the first valve 136 is closed. That is, the liquid ejecting apparatus 111 pressurizes the inside of the second storage portion 135, so that the communication passage 134 is closed by the first valve 136.

Figure 14:
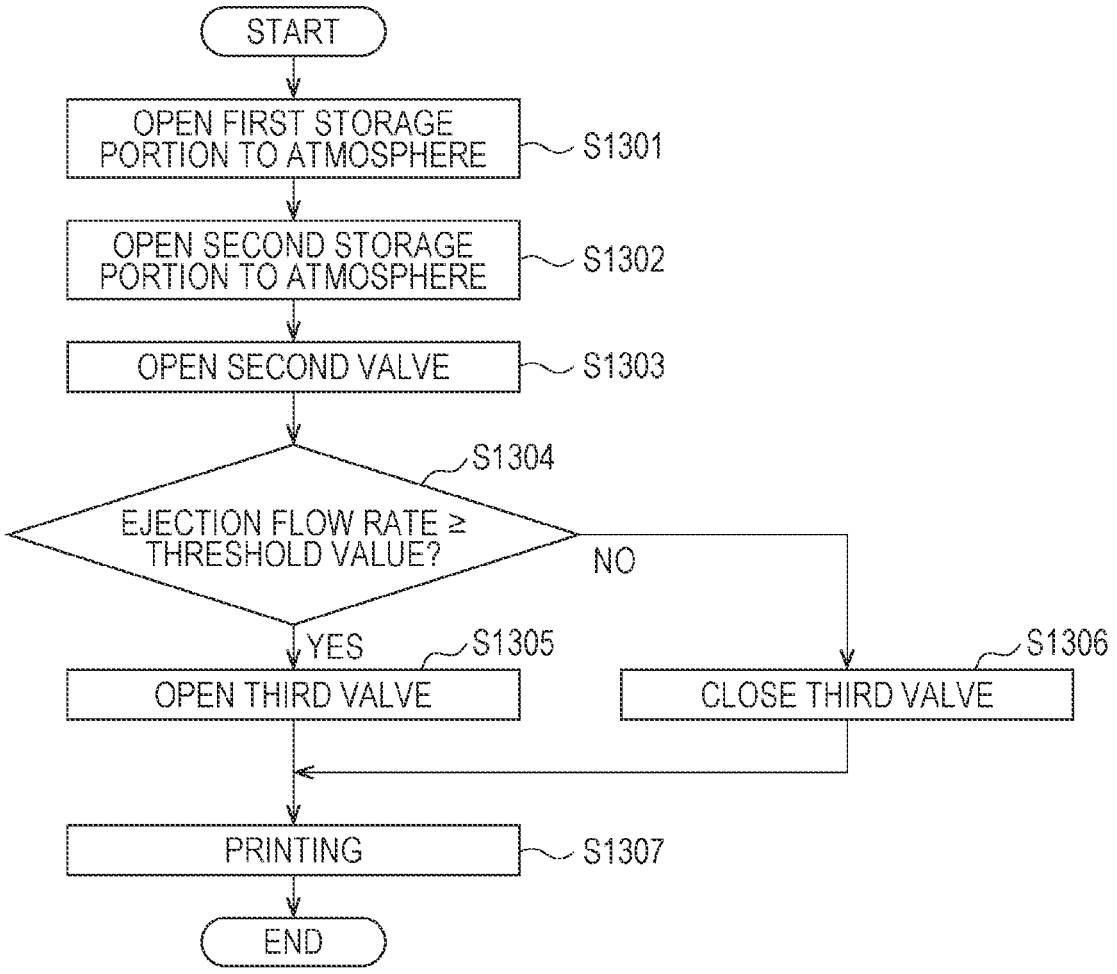
FIG. 14 is a flowchart illustrating a printing routine of the second embodiment.

The printing routine illustrated in FIG. 14 may be performed at the timing in which printing is instructed.

In step S1301, the control portion 119 opens the first storage portion 133 to the atmosphere. In step S1302, the control portion 119 opens the second storage portion 135 to the atmosphere. In step S1303, the control portion 119 opens the second valve 138.

In step S1304, the control portion 119 determines whether or not an ejection flow rate of the liquid generated by ejecting the liquid from the nozzle 122 during printing is equal to or greater than a threshold value. The control portion 119 may calculate the ejection flow rate from print data. When the ejection flow rate is equal to or greater than the threshold value, step S1304 becomes YES, and the control portion 119 shifts the process to step S1305. In step S1305, the control portion 119 opens the third valve 140.

In step S1304, when the ejection flow rate is less than the threshold value, step S1304 becomes NO, and the control portion 119 shifts the process to step S1306. In step S1306, the control portion 119 closes the third valve 140. In step S1307, the control portion 119 performs printing and ends the printing routine.

Here, step S1301 and step S1302 each may be performed at the same time as step S1303 or after step S1303, may be performed at the same time as step S1305 or after step S1305, or may be performed at the same time as step S1306 or after step S1306.

Next, the operation when the printing routine is performed will be described.

As illustrated in FIG. 11, in a case where the ejection flow rate when the liquid ejecting head 123 ejects the liquid to the medium 112 is less than the threshold value, the control portion 119 opens the second valve 138 and closes the third valve 140. That is, the control portion 119 performs printing in a state where the supply flow path 137 is opened by the second valve 138 and the collection flow path 139 is closed by the third valve 140. Therefore, the liquid is supplied to the liquid ejecting head 123 from the second storage portion 135 via the supply flow path 137.

When the ejection flow rate when the liquid ejecting head 123 ejects the liquid to the medium 112 is equal to or greater than the threshold value, the control portion 119 opens the second valve 138 and the third valve 140. That is, the control portion 119 performs printing in a state where the supply flow path 137 is opened by the second valve 138 and the collection flow path 139 is opened by the third valve 140. Therefore, the liquid is supplied from the second storage portion 135 to the liquid ejecting head 123 via the supply flow path 137, and the liquid is also supplied from the first storage portion 133 via the collection flow path 139.

Figure 15:
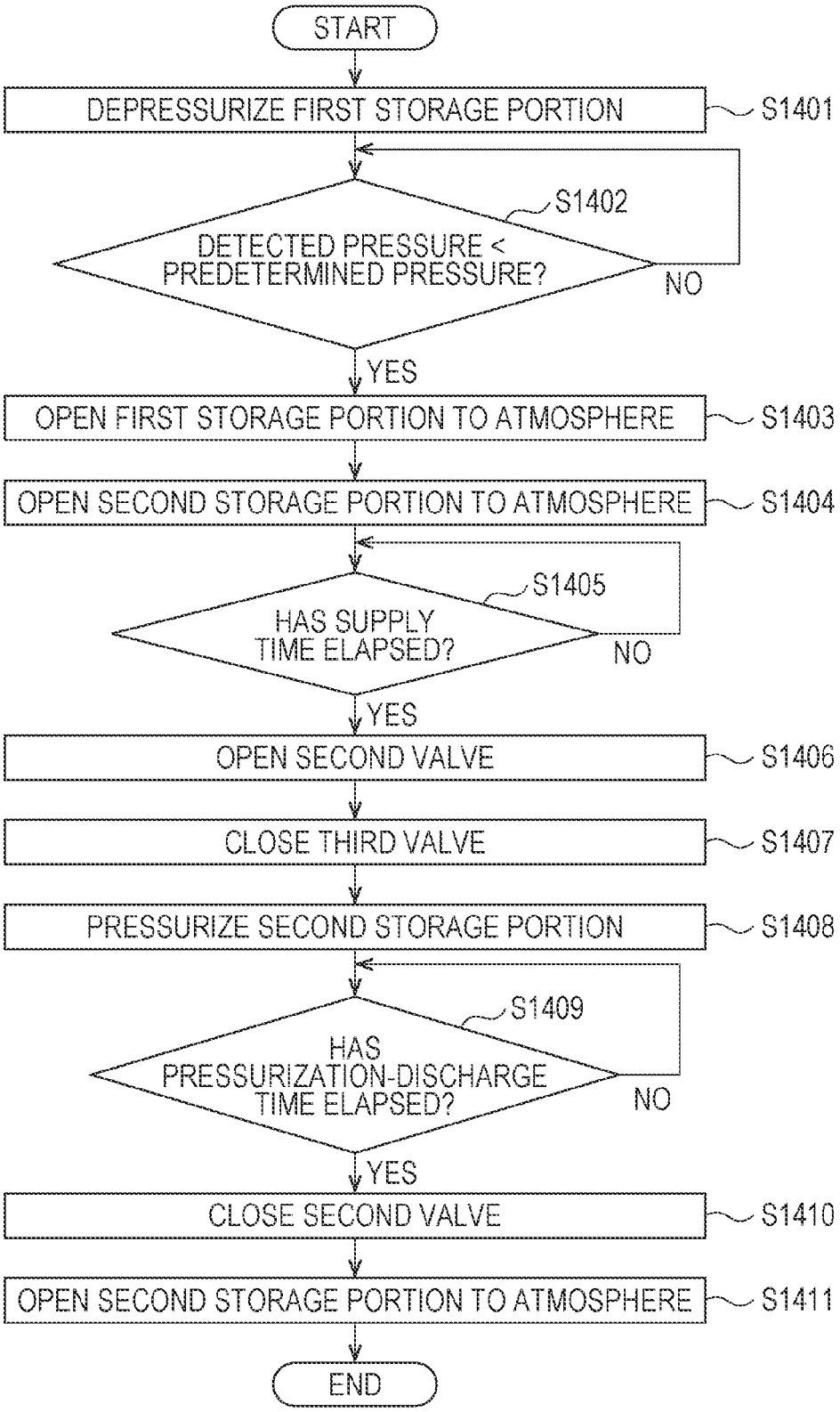
FIG. 15 is a flowchart illustrating a pressurization-discharge routine of the second embodiment.

The pressurization-discharge routine illustrated in FIG. 15 is performed when the performing of the pressurization-discharge is instructed, or when an ejection failure occurs in which the liquid cannot be normally ejected from the nozzle 122.

In step S1401, the control portion 119 depressurizes the inside of the first storage portion 133. In step S1402, the control portion 119 determines whether or not the pressure detected by the pressure sensor 149 has fallen below the predetermined pressure. When the pressure detected by the pressure sensor 149 is equal to or higher than the predetermined pressure, step S1402 becomes NO, and the control portion 119 waits until the detected pressure falls below the predetermined pressure. When the detected pressure falls below the predetermined pressure, step S1402 becomes YES, and the control portion 119 shifts the process to step S1403.

In step S1403, the control portion 119 opens the first storage portion 133 to the atmosphere. In step S1404, the control portion 119 opens the second storage portion 135 to the atmosphere. In step S1405, the control portion 119 determines whether or not a supply time has elapsed after the first storage portion 133 and the second storage portion 135 have been opened to the atmosphere. When the supply time has not elapsed, step S1405 becomes NO, and the control portion 119 waits until the supply time elapses. When the supply time elapses, step S1405 becomes YES, and the control portion 119 shifts the process to step S1406. Here, step S1403 and step S1404 may be performed at the same time or step S1403 may be performed after step S1404.

In step S1406, the control portion 119 opens the second valve 138. In step S1407, the control portion 119 closes the third valve 140. In step S1408, the control portion 119 pressurizes the inside of the second storage portion 135. In step S1409, the control portion 119 determines whether or not a pressurization-discharge time has elapsed after the inside of the second storage portion 135 has been pressurized. The pressurization-discharge time is a time required for the pressure for pressurizing the second storage portion 135 to be transmitted to the nozzle 122 via the supply flow path 137, to discharge the liquid from the nozzle 122, and to restore the state of the nozzle 122. Here, step S1406 and step S1407 each may be performed at the same time as step S1408 or after step S1408.

Step S1409 becomes NO until the pressurization-discharge time elapses, and the control portion 119 waits until the pressurization-discharge time elapses. When the pressurization-discharge time elapses, step S1409 becomes YES, and the control portion 119 shifts the process to step S1410. In step S1410, the control portion 119 closes the second valve 138. In step S1411, the control portion 119 opens the second storage portion 135 to the atmosphere and ends the pressurization-discharge routine. Here, step S1410 may be performed at the same time as step S1411 or may be performed after step S1411.

Next, the operation when the pressurization-discharge is performed will be described.

As illustrated in FIG. 11, the liquid ejecting apparatus 111 depressurizes the inside of the first storage portion 133 by the variable pressure mechanism 147. The liquid ejecting apparatus 111 closes the first valve 136 by making the pressure in the first storage portion 133 lower than the pressure in the second storage portion 135 and the communication passage 134 is closed by the first valve 136. The liquid ejecting apparatus 111 depressurizes the inside of the first storage portion 133, and the liquid is supplied from the liquid accommodating portion 124 to the first storage portion 133. Since the communication passage 134 is closed, the liquid is supplied to the first storage portion 133 and the first liquid level 166 rises, whereas no liquid is supplied to the second storage portion 135.

When the first liquid level 166 rises to the standard position and the float valve 161 separates the depressurization chamber 160 and the first storage chamber 162, the pressure detected by the pressure sensor 149 falls below the predetermined pressure. When the pressure detected by the pressure sensor 149 falls below the predetermined pressure while the variable pressure mechanism 147 depressurizes the inside of the first storage portion 133, the liquid ejecting apparatus 111 may release the depressurization in the first storage portion 133 by the variable pressure mechanism 147. The liquid ejecting apparatus 111 stops driving the variable pressure mechanism 147 and opens the first storage portion 133 and the second storage portion 135 to the atmosphere.

When the first storage portion 133 and the second storage portion 135 are opened to the atmosphere, the first valve 136 is opened, and the communication passage 134 is opened. Therefore, the liquid ejecting apparatus 111 opens the communication passage 134 by the first valve 136, releases the depressurization in the first storage portion 133 by the variable pressure mechanism 147, and supplies the liquid from the first storage portion 133 to the second storage portion 135 by the water head difference. When the heights of the first liquid level 166 and the second liquid level 170 are aligned, the liquid ejecting apparatus 111 opens the second valve 138, and the supply flow path 137 is opened. At this time, the third valve 140 is closed and the collection flow path 139 is closed.

The liquid ejecting apparatus 111 pressurizes the inside of the second storage portion 135 by the variable pressure mechanism 147 and discharges the liquid from the nozzle 122. That is, the liquid ejecting apparatus 111 closes the communication passage 134 again by the first valve 136 by making the pressure in the second storage portion 135 higher than the pressure in the first storage portion 133. The liquid in the second storage portion 135 is supplied to the liquid ejecting head 123 via the supply flow path 137, and is discharged from the nozzle 122 because the collection flow path 139 is closed.

Figure 16:
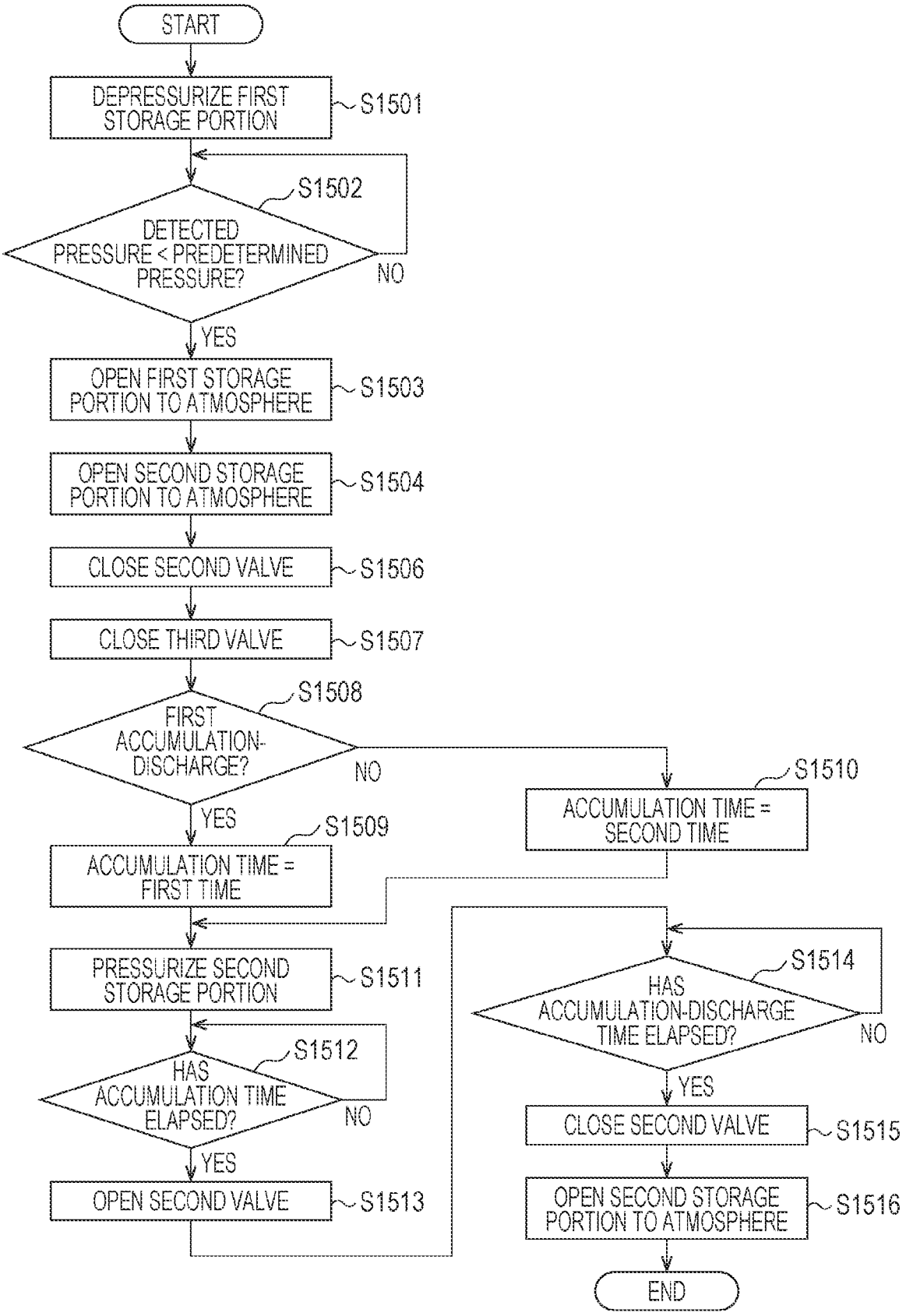
FIG. 16 is a flowchart illustrating an accumulation-discharge routine of the second embodiment.

The accumulation-discharge routine illustrated in FIG. 16 may be performed when the performing of the accumulation-discharge is instructed, or when the ejection failure is not improved even if the pressurization-discharge is performed.

In step S1501, the control portion 119 depressurizes the inside of the first storage portion 133. In step S1502, the control portion 119 determines whether or not the pressure detected by the pressure sensor 149 has fallen below the predetermined pressure. When the pressure detected by the pressure sensor 149 is equal to or higher than the predetermined pressure, step S1502 becomes NO, and the control portion 119 waits until the detected pressure falls below the predetermined pressure. When the detected pressure falls below the predetermined pressure, step S1502 becomes YES, and the control portion 119 shifts the process to step S1503.

In step S1503, the control portion 119 opens the first storage portion 133 to the atmosphere. In step S1504, the control portion 119 opens the second storage portion 135 to the atmosphere. In step S1506, the control portion 119 closes the second valve 138. In step S1507, the control portion 119 closes the third valve 140. In step S1508, the control portion 119 determines whether the performing of a first accumulation-discharge is instructed or the performing of a second accumulation-discharge in which the pressure accumulated is smaller than that of the first accumulation-discharge is instructed, in the accumulation-discharge. When the first accumulation-discharge is performed, step S1508 becomes YES, and the control portion 119 shifts the process to step S1509. In step S1509, the control portion 119 sets an accumulation time to a first time.

When the second accumulation-discharge is performed in step S1508, step S1508 becomes NO, and the control portion 119 shifts the process to step S1510. In step S1510, the control portion 119 sets the accumulation time to a second time shorter than the first time.

In step S1511, the control portion 119 pressurizes the inside of the second storage portion 135. In step S1512, the control portion 119 determines whether or not the accumulation time, which is an example of a predetermined time, has elapsed after the pressurization in the second storage portion 135 has been started. When the accumulation time has not elapsed, step S1512 becomes NO, and the control portion 119 waits until the accumulation time elapses. When the accumulation time elapses, step S1512 becomes YES, and the control portion 119 shifts the process to step S1513.

In step S1513, the control portion 119 opens the second valve 138. In step S1514, the control portion 119 determines whether or not an accumulation-discharge time has elapsed after the second valve 138 has been opened. The accumulation-discharge time is a time required for the pressure accumulated in the second storage portion 135 to be transmitted to the nozzle 122 via the supply flow path 137 and to discharge the liquid from the nozzle 122.

Step S1514 becomes NO until the accumulation-discharge time elapses, and the control portion 119 waits until the accumulation-discharge time elapses. When the accumulation-discharge time elapses, step S1514 becomes YES, and the control portion 119 shifts the process to step S1515. In step S1515, the control portion 119 closes the second valve 138. In step S1516, the control portion 119 opens the second storage portion 135 to the atmosphere and ends the accumulation-discharge routine.

Here, step S1506 and step S1507 each may be performed at the same time as the start of pressurization in step S1511, or immediately after the start of pressurization in step S1511. Further, step S1515 may be performed at the same time as step S1516 or after step S1516. Further, step S1515 may not be performed.

Next, the operation when the accumulation-discharge is performed will be described.

As illustrated in FIG. 11, the liquid ejecting apparatus 111 depressurizes the inside of the first storage portion 133 by the variable pressure mechanism 147. The liquid ejecting apparatus 111 closes the first valve 136 by making the pressure in the first storage portion 133 lower than the pressure in the second storage portion 135 and the communication passage 134 is closed by the first valve 136. The liquid ejecting apparatus 111 depressurizes the inside of the first storage portion 133, and the liquid is supplied from the liquid accommodating portion 124 to the first storage portion 133. Since the communication passage 134 is closed, the liquid is supplied to the first storage portion 133 and the first liquid level 166 rises, whereas no liquid is supplied to the second storage portion 135.

When the first liquid level 166 rises to the standard position and the float valve 161 separates the depressurization chamber 160 and the first storage chamber 162, the pressure detected by the pressure sensor 149 falls below the predetermined pressure. When the pressure detected by the pressure sensor 149 falls below the predetermined pressure while the variable pressure mechanism 147 depressurizes the inside of the first storage portion 133, the liquid ejecting apparatus 111 may release the depressurization in the first storage portion 133 by the variable pressure mechanism 147. The liquid ejecting apparatus 111 stops driving the variable pressure mechanism 147 and opens the first storage portion 133 and the second storage portion 135 to the atmosphere.

When the first storage portion 133 and the second storage portion 135 are opened to the atmosphere, the first valve 136 is opened, and the communication passage 134 is opened. The liquid ejecting apparatus 111 opens the communication passage 134 by the first valve 136, releases the depressurization in the first storage portion 133 by the variable pressure mechanism 147, and supplies the liquid from the first storage portion 133 to the second storage portion 135 by the water head difference.

The liquid ejecting apparatus 111 closes the second valve 138, and the supply flow path 137 is closed by the second valve 138. The liquid ejecting apparatus 111 closes the third valve 140, and the collection flow path 139 is closed by the third valve 140. The liquid ejecting apparatus 111 pressurizes the inside of the second storage portion 135 by the variable pressure mechanism 147. The liquid ejecting apparatus 111 closes the first valve 136 by making the pressure in the second storage portion 135 higher than the pressure in the first storage portion 133 and the communication passage 134 is closed again by the first valve 136. In a state where the communication passage 134 and the supply flow path 137 are closed, the liquid ejecting apparatus 111 pressurizes the inside of the second storage portion 135 by the variable pressure mechanism 147 for the accumulation time.

The magnitude of the pressure accumulated in the second storage portion 135 is proportional to the time for pressurizing the inside of the second storage portion 135 in a state where the communication passage 134 and the supply flow path 137 are closed. In the first accumulation-discharge, the time for pressurizing the inside of the second storage portion 135 by the variable pressure mechanism 147 is a first time. In the second accumulation-discharge, the time for pressurizing the inside of the second storage portion 135 by the variable pressure mechanism 147 is a second time shorter than the first time. The pressure accumulated in the first accumulation-discharge is greater than the pressure accumulated in the second accumulation-discharge. That is, in the first accumulation-discharge, the supply flow path 137 is opened by the second valve 138 when the inside of the second storage portion 135 is pressurized with a first pressure. In the second accumulation-discharge, the supply flow path 137 is opened by the second valve 138 when the inside of the second storage portion 135 is pressurized with a second pressure lower than the first pressure.

When the accumulation-discharge time elapses after the inside of the second storage portion 135 has been pressurized, the liquid ejecting apparatus 111 opens the second valve 138, the supply flow path 137 is opened by the second valve 138, and the liquid is discharged from the nozzle 122.

Figure 17:
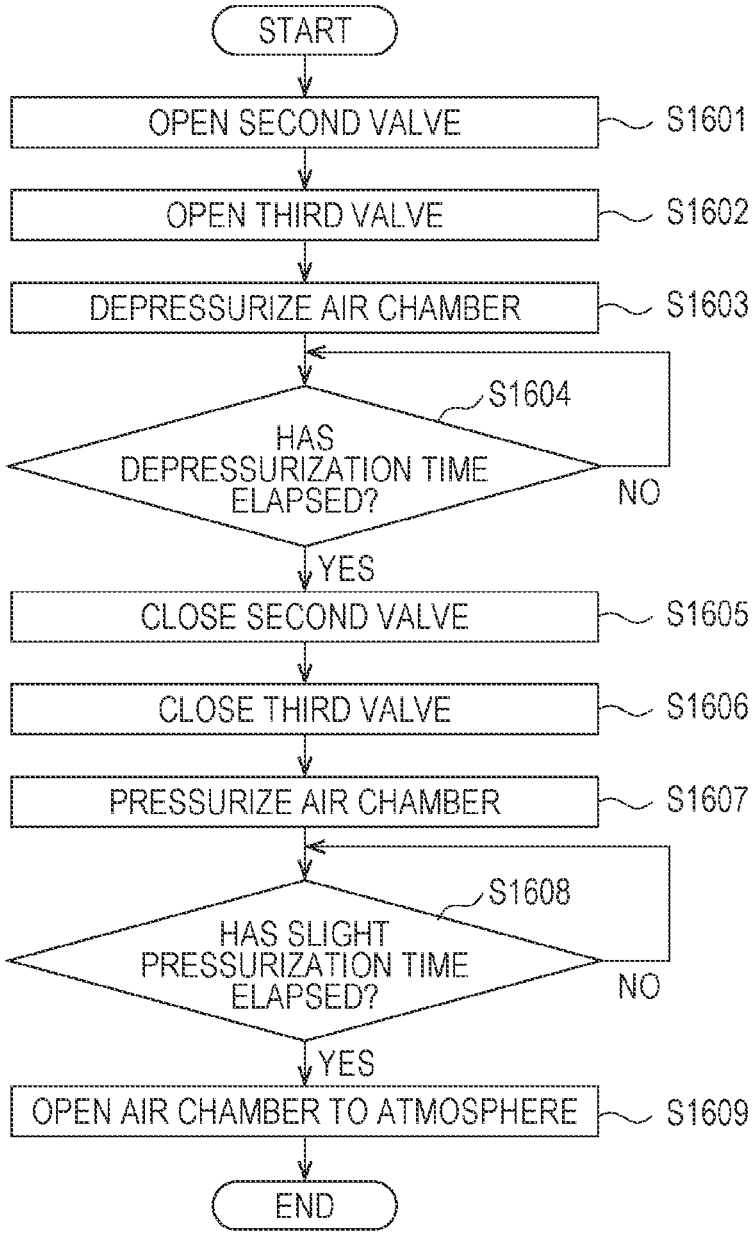
FIG. 17 is a flowchart illustrating a slight pressurization-discharge routine of the second embodiment.

The slight pressurization-discharge routine illustrated in FIG. 17 may be performed when the performing of the slight pressurization-discharge is instructed.

In step S1601, the control portion 119 opens the second valve 138. In step S1602, the control portion 119 opens the third valve 140. In step S1603, the control portion 119 depressurizes the air chamber 153. In step S1604, the control portion 119 determines whether or not the depressurization time has elapsed after the air chamber 153 has been depressurized. The depressurization time is a time required to deform the flexible member 142 and maximize the volume of the liquid chamber 141.

Step S1604 becomes NO until the depressurization time elapses, and the control portion 119 waits until the depressurization time elapses. When the depressurization time elapses, step S1604 becomes YES, and the control portion 119 shifts the process to step S1605. In step S1605, the control portion 119 closes the second valve 138. In step S1606, the control portion 119 closes the third valve 140. In step S1607, the control portion 119 pressurizes the air chamber 153.

In step S1608, the control portion 119 determines whether or not the slight pressurization time has elapsed after the air chamber 153 has been pressurized. The slight pressurization time is a time required for the pressure for pressurizing the air chamber 153 to be transmitted to the nozzle 122 via the liquid chamber 141 and the collection flow path 139.

Step S1608 becomes NO until the slight pressurization time elapses, and the control portion 119 waits until the slight pressurization time elapses. When the slight pressurization time elapses, step S1608 becomes YES, and the control portion 119 shifts the process to step S1609. In step S1609, the control portion 119 opens the air chamber 153 to the atmosphere and ends the slight pressurization-discharge routine.

Here, step S1601 and step S1602 each may be performed at the same time as step S1603 or after step S1603. Further, step S1605 and step S1606 each may be performed during step S1603, may be performed at the same time as the end of step S1603, or may be performed after the end of step S1603. Further, step S1605 and step S1606 each may be performed at the same time as step S1607 or after step S1607.

Next, the operation in the case of performing slight pressurization-discharge will be described.

As illustrated in FIG. 11, the control portion 119 opens the supply flow path 137 and the collection flow path 139 by opening the second valve 138 and the third valve 140. The control portion 119 depressurizes the air chamber 153 and deforms the flexible member 142 to increase the volume of the liquid chamber 141. The liquid flows into the liquid chamber 141 from the first storage portion 133 via the collection flow path 139, and the liquid flows from the second storage portion 135 via the supply flow path 137 and the collection flow path 139.

When the volume of the liquid chamber 141 is maximized, the control portion 119 closes the second valve 138, and the supply flow path 137 is closed by the second valve 138. The control portion 119 closes the third valve 140, and the collection flow path 139 is closed by the third valve 140. In this state, the liquid ejecting apparatus 111 pressurizes the flexible member 142 by sending pressurized air to the air chamber 153 by the variable pressure mechanism 147. That is, the liquid ejecting apparatus 111 pressurizes the flexible member 142 by the pressurizing mechanism 157 and discharges the liquid from the nozzle 122. The pressurizing mechanism 157 pressurizes the liquid chamber 141 with a pressure that breaks the meniscus formed in the nozzle 122. The amount of liquid discharged from the liquid ejecting head 123 by the slight pressurization-discharge is smaller than the amount of liquid discharged from the liquid ejecting head 123 by the pressurization-discharge.

Figure 18:
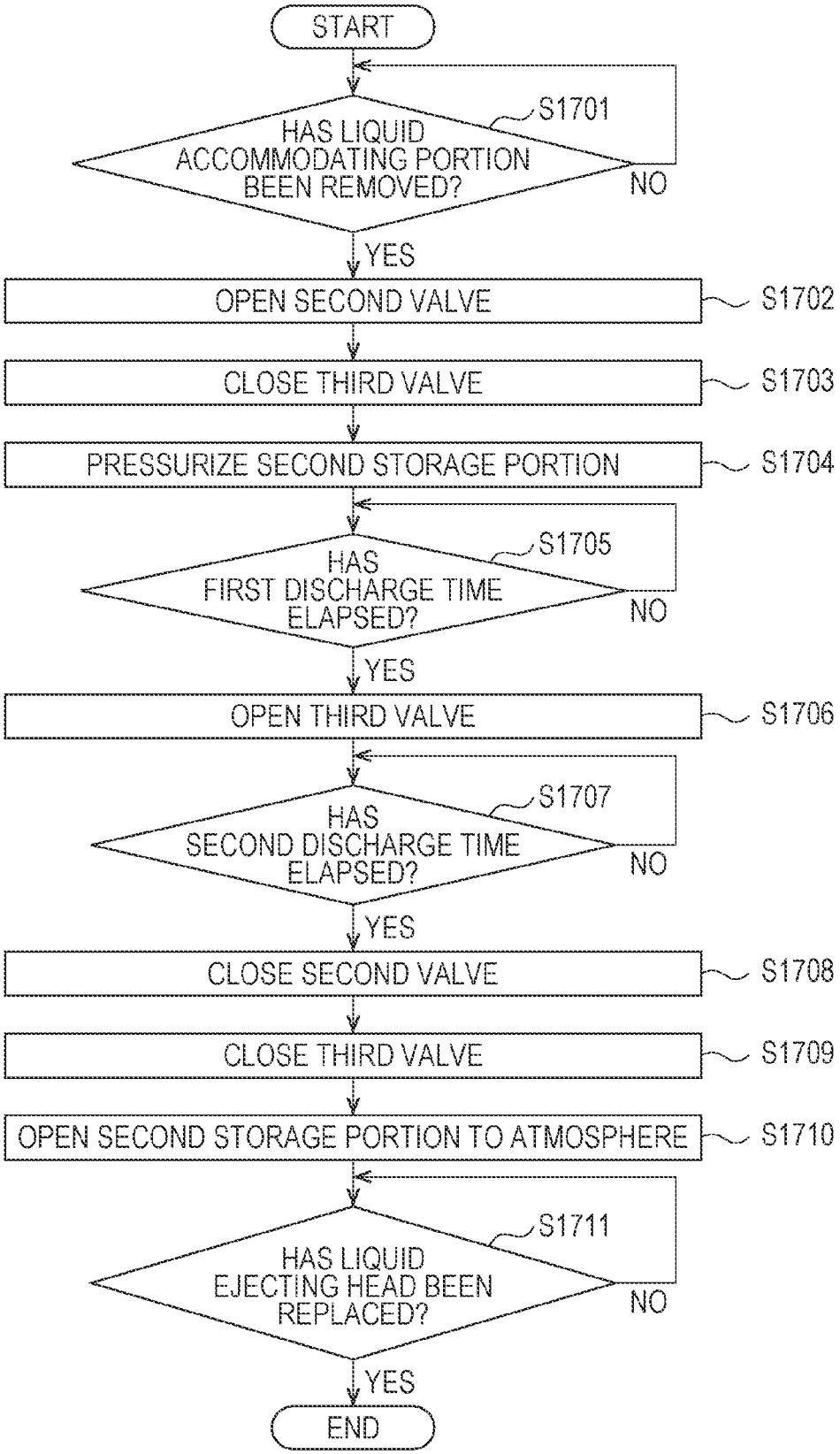
FIG. 18 is a flowchart illustrating a head replacement routine of the second embodiment.

The head replacement routine illustrated in FIG. 18 may be performed when the liquid ejecting head 123 is replaced.

In step S1701, the control portion 119 determines whether or not the liquid accommodating portion 124 has been removed from the mounting portion 128. When the liquid accommodating portion 124 is mounted on the mounting portion 128, step S1701 becomes NO, and the control portion 119 waits until the liquid accommodating portion 124 is removed. When the liquid accommodating portion 124 is removed, step S1701 becomes YES, and the control portion 119 shifts the process to step S1702.

In step S1702, the control portion 119 opens the second valve 138. In step S1703, the control portion 119 closes the third valve 140. In step S1704, the control portion 119 pressurizes the inside of the second storage portion 135. In step S1705, the control portion 119 determines whether or not a first discharge time has elapsed after the inside of the second storage portion 135 has been pressurized. The first discharge time is a time required to discharge the liquid stored in the second storage portion 135 via the supply flow path 137 and the liquid ejecting head 123.

Step S1705 becomes NO until the first discharge time elapses, and the control portion 119 waits until the first discharge time elapses. When the first discharge time elapses, step S1705 becomes YES, and the control portion 119 shifts the process to step S1706. In step S1706, the control portion 119 opens the third valve 140.

In step S1707, the control portion 119 determines whether or not a second discharge time has elapsed after the third valve 140 has been opened. The second discharge time is a time required to collect the liquid in the collection flow path 139 to the first storage portion 133.

Step S1707 becomes NO until the second discharge time elapses, and the control portion 119 waits until the second discharge time elapses. When the second discharge time elapses, step S1707 becomes YES, and the control portion 119 shifts the process to step S1708. In step S1708, the control portion 119 closes the second valve 138. In step S1709, the control portion 119 closes the third valve 140.

In step S1710, the control portion 119 opens the second storage portion 135 to the atmosphere. In step S1711, the control portion 119 determines whether or not the liquid ejecting head 123 has been replaced. When the liquid ejecting head 123 has not been replaced, step S1711 becomes NO, and the control portion 119 waits until the liquid ejecting head 123 is replaced. When the liquid ejecting head 123 is replaced, step S1711 becomes YES, and the control portion 119 ends the head replacement routine.

Here, step S1702 and step S1703 each may be performed at the same time as the start of pressurization in step S1704, or immediately after the start of pressurization in step S1704. Further, step S1708 and step S1709 each may be performed at the same time as step S1710 or after step S1710.

Next, the head replacement routine will be described.

As illustrated in FIG. 11, when the liquid ejecting head 123 is replaced, an operator performs the head replacement routine and removes the liquid accommodating portion 124 from the mounting portion 128. Subsequently, the control portion 119 opens the second valve 138, and the supply flow path 137 is opened by the second valve 138. The control portion 119 closes the third valve 140, and the collection flow path 139 is closed by the third valve 140. In this state, the control portion 119 pressurizes the inside of the second storage portion 135.

Specifically, the liquid ejecting apparatus 111 pressurizes the inside of the second storage portion 135 by the variable pressure mechanism 147, and discharges the liquid from the second storage portion 135 to the liquid ejecting head 123 from the nozzle 122. At this time, since the pressure of the second storage portion 135 becomes higher than the pressure of the first storage portion 133, the first valve 136 is closed. That is, the liquid ejecting apparatus 111 pressurizes the second storage portion 135, so that the communication passage 134 is closed by the first valve 136.

When the liquid in the second storage portion 135, the supply flow path 137, and the liquid ejecting head 123 is discharged, the control portion 119 opens the third valve 140, and the collection flow path 139 is opened by the third valve 140. That is, the liquid ejecting apparatus 111 pressurizes the inside of the second storage portion 135 by the variable pressure mechanism 147, and collects the liquid in the collection flow path 139 to the first storage portion 133. The operator replaces the liquid ejecting head 123 in a state where the liquid is drained from the supply flow path 137, the liquid ejecting head 123, and the collection flow path 139.

The effect of the present embodiment will be described.

(1) The communication passage 134 communicating with the first storage portion 133 and the supply flow path 137 communicating with the liquid ejecting head 123 are coupled to the second storage portion 135. The communication passage 134 can be closed by the first valve 136 when the variable pressure mechanism 147 pressurizes the inside of the second storage portion 135. Therefore, the pressurized liquid in the second storage portion 135 is supplied to the liquid ejecting head 123 via the supply flow path 137. Therefore, the liquid from the nozzle 122 can be discharged by pressurizing the liquid in the liquid ejecting head 123, and the possibility that the liquid ejecting head 123 draws the liquid from the nozzle 122 can be reduced.

(2) When the inside of the first storage portion 133 is depressurized by the variable pressure mechanism 147, the liquid is supplied from the liquid accommodating portion 124. When the height of the liquid level in the first storage portion 133 reaches a predetermined height, the float valve 161 closes the depressurization flow path 148 and stops the depressurization in the first storage portion 133. Therefore, the possibility that the liquid overflows from the first storage portion 133 can be reduced.

(3) When the variable pressure mechanism 147 pressurizes the inside of the second storage portion 135 in a state where the first valve 136 closes the communication passage 134 and the second valve 138 closes the supply flow path 137, a pressurizing force is accumulated in the second storage portion 135. Therefore, by opening the second valve 138 in a state where the pressure in the second storage portion 135 is increased, a high pressure can be transmitted to the liquid ejecting head 123, and for example, a thickened liquid can be easily discharged.

(4) When the variable pressure mechanism 147 pressurizes the inside of the second storage portion 135 in a state where the third valve 140 is closed, the liquid is discharged from the liquid ejecting head 123. When the variable pressure mechanism 147 pressurizes the inside of the second storage portion 135 in a state where the third valve 140 is opened, the liquid in the liquid ejecting head 123 is collected in the first storage portion 133 via the collection flow path 139. Therefore, maintenance can be selected and performed according to, for example, the state of air bubbles in the supply flow path 137 and the state of the nozzle 122.

(5) For example, when the first valve 136 is driven to close the communication passage 134, a drive source for driving the first valve 136 is required. In that respect, the first valve 136 has a check valve. Specifically, the first valve 136 allows the flow of the liquid supplied from the first storage portion 133 to the second storage portion 135 due to the water head difference, but restricts the flow of the liquid from the second storage portion 135 to the first storage portion 133 when the inside of the second storage portion 135 is pressurized. Therefore, the first valve 136 does not need to be driven, and the drive source can be reduced.

(6) In the pressurization-discharge, the liquid is supplied in this order from the liquid accommodating portion 124 to the first storage portion 133, from the first storage portion 133 to the second storage portion 135, and from the second storage portion 135 to the liquid ejecting head 123, and the liquid is discharged from the nozzle 122 provided in the liquid ejecting head 123. The liquid in the second storage portion 135 is supplied to the liquid ejecting head 123 via the supply flow path 137 by being pressurized by the variable pressure mechanism 147 in a state where the communication passage 134 is closed. Therefore, the liquid ejecting apparatus 111 can discharge the liquid from the nozzle 122 by pressurizing the liquid in the liquid ejecting head 123, and the possibility that the liquid ejecting head 123 draws the liquid from the nozzle 122 can be reduced.

(7) When the pressure detected by the pressure sensor 149 falls below the predetermined pressure, the variable pressure mechanism 147 releases the depressurization in the first storage portion 133. Therefore, even if the float valve 161 cannot close the depressurization flow path 148, for example, when the float valve 161 is displaced, the possibility that the liquid overflows from the first storage portion 133 can be reduced.

(8) In the accumulation-discharge, the variable pressure mechanism 147 pressurizes the inside of the second storage portion 135 in a state where the first valve 136 closes the communication passage 134 and the second valve 138 closes the supply flow path 137, so that the pressurizing force is accumulated in the second storage portion 135. In the accumulation-discharge, when the supply flow path 137 is opened by the second valve 138 after inside of the second storage portion 135 has been pressurized, the accumulated high pressure can be transmitted to the liquid ejecting head 123, and for example, a thickened liquid can be easily discharged.

(9) In the entire filling, by combining the opening and closing of the first valve 136, the second valve 138, and the third valve 140 with the drive of the variable pressure mechanism 147, the liquid can be supplied from the liquid accommodating portion 124 to the first storage portion 133, and the second storage portion 135, the supply flow path 137, the liquid ejecting head 123, and the collection flow path 139 can be filled with the liquid. Therefore, the entire flow path can be filled with the liquid by performing the entire filling.

The present embodiment can be implemented by changing as follows. The present embodiment and the following modification examples can be implemented in combination with each other unless there is a technical contradiction.

The liquid ejecting apparatus 111 may include a wiping member (not illustrated) that wipes the nozzle surface 121. The liquid ejecting apparatus 111 may wipe the nozzle surface 121 with a wiping member after discharging the liquid from the nozzle 122. The liquid ejecting apparatus 111 may have the operator wipe the nozzle surface 121 before removing the liquid ejecting head 123.

The control portion 119 may control the opening and closing of the first valve 136. The control portion 119 may close the communication passage 134 by the first valve 136 before depressurizing the inside of the first storage portion 133 and before pressurizing the inside of the second storage portion 135.

In the second accumulation-discharge, after the inside of the second storage portion 135 has been pressurized for the first time in a state where the first valve 136 and the second valve 138 are closed to make the pressure in the second storage portion 135 the first pressure, the first valve 136 may be opened to reduce the pressure in the second storage portion 135 to the second pressure, and then the second valve 138 may be opened.

In the slight pressurization-discharge, the liquid in the liquid chamber 141 may be pressurized by pushing the flexible member 142 with the spring 154. In this case, the control portion 119 depressurizes the air chamber 153 to increase the volume of the liquid chamber 141, and then opens the air chamber 153 to the atmosphere. When the air chamber 153 reaches the atmospheric pressure, the spring 154 pushes the liquid in the liquid chamber 141 and discharges the liquid from the liquid ejecting head 123. In the case of the configuration in which the flexible member 142 is pushed by the spring 154, the spring 154 is included in the pressurizing mechanism 157.

The liquid ejecting apparatus 111 may perform printing in a state where the collection flow path 139 is opened by the third valve 140 regardless of the ejection flow rate.

The liquid ejecting head 123 may have a plurality of pressure chambers individually communicating with the plurality of nozzles 122, a common liquid chamber communicating with the plurality of pressure chambers, and a filter chamber in which the filter is housed. The first coupling portion 144 and the second coupling portion 145 are coupled to at least one of a pressure chamber, a common liquid chamber, and a filter chamber. For example, when the first coupling portion 144 and the second coupling portion 145 are coupled to the filter chamber, the liquid ejecting apparatus 111 can collect the air bubbles trapped in the filter together with the liquid in the first storage portion 133 by performing the liquid circulation. The liquid ejecting apparatus 111 may perform liquid circulation when air bubbles are generated in the liquid ejecting head 123.

The second valve 138 and the third valve 140 may be closed, and the supply flow path 137 and the collection flow path 139 may be closed when the liquid ejecting apparatus 111 is on standby and when the power is turned off. By closing the supply flow path 137 and the collection flow path 139, it is possible to reduce the possibility of liquid leaking from the liquid ejecting head 123 even when vibration or impact is applied to the liquid ejecting apparatus 111, for example.

The amount of liquid that can be stored in the second storage portion 135 may be less than the amount of liquid required for pressurization-discharge. In this case, the control portion 119 may alternately perform supply the liquid from the second storage portion 135 to the liquid ejecting head 123 by pressurizing the inside of the second storage portion 135, and supply the liquid from the first storage portion 133 to the second storage portion 135 by opening the second storage portion 135 to the atmosphere.

The amount of liquid stored in the second storage portion 135 when the first liquid level 166 and the second liquid level 170 are located in the replenishment position may be greater than the amount required for printing while the liquid is supplied from the liquid accommodating portion 124 to the first storage portion 133. As a result, printing can be continued while the liquid is supplied from the liquid accommodating portion 124 to the first storage portion 133.

The amount of liquid accommodated in the liquid accommodating portion 124 may be less than the amount of liquid that can be held by the supply mechanism 125. In this case, the liquid accommodating portion 124 may be replaced during the entire filling in which the supply mechanism 125 is filled with the liquid.

In accumulation-discharge, after the communication passage 134 is closed by the first valve 136 and the inside of the second storage portion 135 is pressurized in a state where the supply flow path 137 is closed by the second valve 138, when the pressure sensor 149 detects that the pressure has reached a predetermined pressure, the supply flow path 137 may be opened by the second valve 138. At this time, the control portion 119 may perform a first accumulation-discharge in which the supply flow path 137 is opened when the pressure sensor 149 detects that the pressure has reached a first pressure, and a second accumulation-discharge in which the supply flow path 137 is opened when the pressure sensor 149 detects that the pressure has reached a second pressure smaller than the first pressure. The first pressure and the second pressure are larger than a pressurizing force that pressurizes the second storage portion 135 at the time of pressurization-discharge.

The control portion 119 may depressurize the inside of the first storage portion 133 when the liquid flows into the first storage portion 133 from the collection flow path 139.

The control portion 119 may remove air bubbles from the liquid by depressurizing the inside of the first storage portion 133 and expanding the air bubbles contained in the liquid stored in the first storage portion 133.

The liquid ejecting apparatus 111 may simultaneously perform depressurization in the first storage portion 133 and pressurization in the second storage portion 135. Specifically, the liquid ejecting apparatus 111 may open the fourth selection valve 173*d* and the eighth selection valve 173*h*, close the other selection valves, and drive the variable pressure mechanism 147 to rotate in the normal direction. At this time, the liquid ejecting apparatus 111 may open the second selection valve 173*b* and cause the pressure sensor 149 to detect the pressure in the depressurization flow path 148. The liquid ejecting apparatus 111 may open the fifth selection valve 173*e* and cause the pressure sensor 149 to detect the pressure in the pressurization flow path 151.

The flow path resistance when the liquid moves in the depressurization chamber 160 and the depressurization flow path 148 may be larger than the flow path resistance when the first liquid level 166 rises in the first storage chamber 162. The predetermined pressure that serves as a guide for releasing the depressurization in the first storage portion 133 when the inside of the first storage portion 133 is depressurized is a negative pressure, and the predetermined pressure may be larger than the negative pressure that raises the first liquid level 166 in the first storage chamber 162 and may be smaller than the negative pressure that moves the liquid in the depressurization chamber 160 or the depressurization flow path 148.

When the liquid amount sensor 163 detects that the first liquid level 166 is located at the standard position, the liquid ejecting apparatus 111 may release the depressurization in the first storage portion 133.

The liquid ejecting apparatus 111 may release the depressurization in the first storage portion 133 by opening the first selection valve 173*a* and communicating the depressurization flow path 148 with the atmosphere. In this case, the variable pressure mechanism 147 may continue to be driven.

Entire filling, pressurization-discharge, slight pressurization-discharge, and liquid circulation may be performed a plurality of times or in combination. When the amount of liquid that can be stored in the first storage portion 133 is less than the amount of liquid that is filled in the supply flow path 137, the collection flow path 139, and the liquid ejecting head 123, the supply flow path 137, the collection flow path 139, and the liquid ejecting head 123 may be filled with the liquid by performing the entire filling a plurality of times. For example, the slight pressurization-discharge may be performed after the entire filling is performed. By combining entire filling and slight pressurization-discharge, it is possible to reduce the occurrence of ejection failures as compared with the case where only entire filling is performed.

The first storage portion 133 and the second storage portion 135 may be integrally configured.

The flexible member 142 may be formed of a rubber film, an elastomer film, a film, or the like.

The liquid chamber 141 may be provided in the supply flow path 137. The pressurizing mechanism 157 may pressurize the liquid chamber provided in the supply flow path 137.

The variable pressure mechanism 147 may use a diaphragm pump, a piston pump, a gear pump, or the like.

The liquid ejecting head 123 may eject the liquid in a horizontal posture in which the nozzle surface 121 is horizontal and perform printing on the medium 112. The liquid ejecting head 123 may be provided so that the posture can be changed between a horizontal posture and an inclined posture.

The liquid ejecting apparatus 111 may be provided with an atmosphere opening path for opening the second storage portion 135 to the atmosphere separately from the pressurization flow path 151.

In the head replacement routine illustrated in FIG. 18, the control portion 119 may perform steps S1702 to S1705 again after performing step S1710. As a result, the liquid collected in the first storage portion 133 can be discharged from the liquid ejecting head 123.

The liquid ejecting apparatus 11 and the liquid ejecting apparatus 111 may be liquid ejecting apparatuses that eject and discharge liquids other than an ink. The state of the liquid ejected as a minute amount of droplets from the liquid ejecting apparatus includes those having a granular, tear-like, or thread-like tail. The liquid referred to here may be any material that can be ejected from the liquid ejecting apparatus. For example, the liquid may be in the state when the substance is in the liquid phase, and the liquid includes fluids such as highly viscous or low viscous liquids, sol, gel water, other inorganic solvents, organic solvents, solutions, liquid resins, liquid metals, metal melts, and the like. The liquid includes not only a liquid as a state of a substance but also a liquid in which particles of a functional material made of a solid substance such as a pigment or a metal particle are dissolved, dispersed, or mixed in a solvent. Typical examples of the liquid include ink, liquid crystal, and the like as described in the above-described embodiment. Here, the ink includes general water-based inks, oil-based inks, and various liquid compositions such as gel inks and hot melt inks. Specific examples of the liquid ejecting apparatus include an apparatus that ejects a liquid containing a material such as an electrode material or a color material used for manufacturing a liquid crystal display, an electroluminescence display, a surface emitting display, or a color filter in a dispersed or dissolved form, for example. The liquid ejecting apparatus may be an apparatus that ejects a bioorganic substance used for manufacturing a biochip, an apparatus that ejects a liquid as a sample used as a precision pipette, a printing device, a micro dispenser, or the like. The liquid ejecting apparatus may be an apparatus that ejects lubricating oil to a precision machine such as a watch or a camera in a pinpoint manner, or an apparatus that ejects a transparent resin liquid such as an ultraviolet curable resin onto a substrate in order to form a micro hemispherical lens, an optical lens, or the like used for an optical communication element or the like. The liquid ejecting apparatus may be an apparatus that ejects an etching solution such as an acid or an alkali in order to etch a substrate or the like.

Hereinafter, the technical idea and the effect thereof figured out from the above-described embodiment and the modification examples will be described.

(A) There is provided a liquid ejecting apparatus including: a liquid ejecting head configured to eject a liquid from a nozzle provided on a nozzle surface; a first storage portion that has an introduction portion into which the liquid accommodated in a liquid accommodating portion is introduced, the introduction portion being provided at an upper portion of the first storage portion, the first storage portion being configured so that a liquid level fluctuates in a range lower than the nozzle surface; a second storage portion that communicates with the first storage portion via a communication passage and to which the liquid is supplied from the first storage portion due to a water head difference; a supply flow path for supplying the liquid from the second storage portion to the liquid ejecting head; a pressurizing portion that pressurizes an inside of the second storage portion; and a first valve configured to close the communication passage at the time of pressurization by the pressurizing portion.

With this configuration, the communication passage communicating with the first storage portion and the supply flow path communicating with the liquid ejecting head are coupled to the second storage portion. The communication passage can be closed by the first valve when the pressurizing portion pressurizes the inside of the second storage portion. Therefore, the pressurized liquid in the second storage portion is supplied to the liquid ejecting head via the supply flow path. Therefore, the liquid ejecting apparatus can discharge the liquid from the nozzle by pressurizing the liquid in the liquid ejecting head, and the possibility that the liquid ejecting head draws the liquid from the nozzle can be reduced.

(B) The liquid ejecting apparatus may further include a second valve provided in the supply flow path between the second storage portion and the liquid ejecting head, and configured to open and close the supply flow path.

With this configuration, when the pressurizing portion pressurizes the inside of the second storage portion in a state where the first valve closes the communication passage and the second valve closes the supply flow path, a pressurizing force is accumulated in the second storage portion. Therefore, by opening the second valve in a state where the pressure in the second storage portion is increased, a high pressure can be transmitted to the liquid ejecting head, and for example, a thickened liquid can be easily discharged.

(C) The liquid ejecting apparatus may further include a collection flow path for collecting the liquid from the liquid ejecting head to the first storage portion, and a third valve configured to open and close the collection flow path.

With this configuration, when the pressurizing portion pressurizes the inside of the second storage portion in a state where the third valve closes the collection flow path, the liquid is discharged from the liquid ejecting head. When the pressurizing portion pressurizes the inside of the second storage portion in a state where the third valve opens the collection flow path, the liquid in the liquid ejecting head is collected in the first storage portion via the collection flow path. Therefore, maintenance can be selected and performed according to, for example, the state of air bubbles in the supply flow path and the state of the nozzle.

(D) The liquid ejecting apparatus may further include a slight pressurizing portion that has a liquid chamber partially composed of a flexible member and a pressurizing mechanism configured to pressurize the flexible member from an outside of the liquid chamber, the slight pressurizing portion being provided in the collection flow path between the liquid ejecting head and the third valve.

With this configuration, when the pressurizing mechanism pressurizes the liquid chamber in a state where the third valve closes the collection flow path, the liquid is discharged from the liquid ejecting head. The amount of liquid discharged at this time is determined by the size of the liquid chamber. Therefore, as compared with the case where the pressurizing portion pressurizes the inside of the second storage portion, a slight pressurizing enough to break the meniscus formed in the nozzle can be applied to the liquid ejecting head with higher accuracy.

(E) In the liquid ejecting apparatus, the pressurizing mechanism may include the pressurizing portion, an air chamber separated from the liquid chamber via the flexible member, and an air flow path through which the pressurizing portion communicates with the air chamber.

With this configuration, the pressurizing mechanism includes a pressurizing portion that pressurizes the inside of the second storage portion. The pressurizing portion pushes the flexible member by pressurizing the air chamber via the air flow path, and pressurizes the liquid chamber. Therefore, the pressurizing portion can pressurize the liquid in the second storage portion and the liquid in the liquid chamber.

(F) In the liquid ejecting apparatus, a first coupling portion between the liquid ejecting head and the collection flow path may be disposed at a position higher than a second coupling portion between the liquid ejecting head and the supply flow path.

With this configuration, the first coupling portion to which the collection flow path is coupled is disposed at a position higher than the second coupling portion to which the supply flow path is coupled. Since the air bubbles in the liquid ejecting head are likely to collect at a higher position due to buoyancy, they are more likely to collect at the first coupling portion than at the second coupling portion. Therefore, by collecting the liquid in the liquid ejecting head to the first storage portion via the collection flow path, air bubbles can be easily discharged from the liquid ejecting head.

(G) In the liquid ejecting apparatus, the first valve includes a check valve that allows a flow of the liquid from the first storage portion to the second storage portion and restricts a flow of the liquid from the second storage portion to the first storage portion.

For example, when the first valve is driven to close the communication passage, a drive source for driving the first valve is required. In that respect, with this configuration, the first valve has a check valve. Specifically, the first valve allows the flow of the liquid supplied from the first storage portion to the second storage portion due to the water head difference, but restricts the flow of the liquid from the second storage portion to the first storage portion when the inside of the second storage portion is pressurized. Therefore, the first valve does not need to be driven, and the drive source can be reduced.

(H) In the liquid ejecting apparatus, the liquid ejecting head may be disposed so that the nozzle surface is inclined with respect to a horizontal.

With this configuration, the nozzle surface of the liquid ejecting head is inclined with respect to the horizontal. Therefore, the degree of freedom in disposing the liquid ejecting head can be improved.

(I) There is provided a control method of a liquid ejecting apparatus including a liquid ejecting head that ejects a liquid from a nozzle provided on a nozzle surface, a first storage portion that has an introduction portion into which the liquid accommodated in a liquid accommodating portion is introduced, the introduction portion being provided at an upper portion of the first storage portion, a second storage portion that communicates with the first storage portion via a communication passage, a supply flow path for supplying the liquid from the second storage portion to the liquid ejecting head, a first valve configured to open and close the communication passage, and a pressurizing portion that pressurizes an inside of the second storage portion. The control method includes performing a pressurization-discharge including closing the communication passage by the first valve, and pressurizing the inside of the second storage portion by the pressurizing portion to discharge the liquid from the nozzle.

With this method, in the pressurization-discharge, the communication passage is closed by the first valve, and the inside of the second storage portion is pressurized by the pressurizing portion. The pressurized liquid in the second storage portion is supplied to the liquid ejecting head via the supply flow path. Therefore, the liquid ejecting apparatus can discharge the liquid from the nozzle by pressurizing the liquid in the liquid ejecting head, and the possibility that the liquid ejecting head draws the liquid from the nozzle can be reduced.

(J) In the control method of a liquid ejecting apparatus, the liquid ejecting apparatus may further include a second valve provided in the supply flow path between the second storage portion and the liquid ejecting head, and configured to open and close the supply flow path, the control method may further include performing an accumulation-discharge, and the performing of the accumulation-discharge may include closing the communication passage by the first valve, closing the supply flow path by the second valve, and pressurizing the inside of the second storage portion by the pressurizing portion and then opening the supply flow path by the second valve to discharge the liquid from the nozzle.

With this method, in the accumulation-discharge, the pressurizing portion pressurizes the inside of the second storage portion in a state where the first valve closes the communication passage and the second valve closes the supply flow path, so that the pressurizing force is accumulated in the second storage portion. In the accumulation-discharge, since the second valve is opened after inside of the second storage portion has been pressurized, the accumulated high pressure can be transmitted to the liquid ejecting head, and for example, a thickened liquid can be easily discharged.

(K) In the control method of a liquid ejecting apparatus, in the performing of the accumulation-discharge, performing a first accumulation-discharge in which the supply flow path is opened by the second valve while the inside of the second storage portion is pressurized with a first pressure, and performing a second accumulation-discharge in which the supply flow path is opened by the second valve while the inside of the second storage portion is pressurized with a second pressure lower than the first pressure.

In the first accumulation-discharge, the supply flow path is opened by the second valve when the inside of the second storage portion is pressurized with the first pressure, and the liquid is discharged from the nozzle. In the second accumulation-discharge, the supply flow path is opened by the second valve when the inside of the second storage portion is pressurized with a second pressure lower than the first pressure, and the liquid is discharged from the nozzle. Therefore, for example, by combining the first accumulation-discharge and the second accumulation-discharge according to the configuration of the supply flow path, the supply flow path can be efficiently filled with the liquid.

(L) In the control method of a liquid ejecting apparatus, in the performing of the accumulation-discharge, performing a first accumulation-discharge in which a time for pressurizing the inside of the second storage portion by the pressurizing portion is a first time, and performing a second accumulation-discharge in which a time for pressurizing the inside of the second storage portion by the pressurizing portion is a second time shorter than the first time.

When the pressurizing portion is driven in a state where the communication passage and the supply flow path are closed, the longer the driving time, the higher the accumulated pressure. In that respect, with this method, in the first accumulation-discharge, the supply flow path is opened by the second valve after pressurizing the inside of the second storage portion for the first time, and the liquid is discharged from the nozzle. In the second accumulation-discharge, the supply flow path is opened by the second valve after pressurizing the inside of the second storage portion for the second time shorter than the first time, and the liquid is discharged from the nozzle. Therefore, for example, by combining the first accumulation-discharge and the second accumulation-discharge according to the configuration of the supply flow path, the supply flow path can be efficiently filled with the liquid.

(M) In the control method of a liquid ejecting apparatus, the liquid ejecting apparatus may further include a second valve provided in the supply flow path between the second storage portion and the liquid ejecting head, and configured to open and close the supply flow path, a collection flow path for collecting the liquid from the liquid ejecting head to the first storage portion, and a third valve configured to open and close the collection flow path, the control method may further include performing a liquid circulation, and the performing of the liquid circulation may include closing the communication passage by the first valve, opening the supply flow path by the second valve, opening the collection flow path by the third valve, and pressurizing the inside of the second storage portion by the pressurizing portion to cause the liquid to flow from the second storage portion to the first storage portion via the liquid ejecting head.

With this method, when the liquid circulation is performed, the liquid is collected from the second storage portion to the first storage portion via the supply flow path, the liquid ejecting head, and the collection flow path. The air bubbles in the supply flow path and the liquid ejecting head move together with the liquid. Therefore, the air bubbles can be collected without discharging the liquid from the liquid ejecting head.

(N) In the control method of a liquid ejecting apparatus, the liquid ejecting apparatus may further include a second valve provided in the supply flow path between the second storage portion and the liquid ejecting head, and configured to open and close the supply flow path, a collection flow path for collecting the liquid from the liquid ejecting head to the first storage portion, a third valve configured to open and close the collection flow path, and a slight pressurizing portion that pressurizes the liquid in the collection flow path, the slight pressurizing portion may be provided in the collection flow path between the liquid ejecting head and the third valve, and has a liquid chamber partially composed of a flexible member and a pressurizing mechanism configured to pressurize the flexible member from an outside of the liquid chamber, the control method may further include performing a slight pressurization-discharge, and the performing of the slight pressurization-discharge may include closing the supply flow path by the second valve, closing the collection flow path by the third valve, and pressurizing the flexible member by the pressurizing mechanism to discharge the liquid from the nozzle.

With this method, in the slight pressurization-discharge, the pressurizing mechanism pressurizes the flexible member in a state where the second valve closes the supply flow path and the third valve closes the collection flow path, so that the liquid in the liquid chamber is pressurized, and the liquid is discharged from the liquid ejecting head. The amount of liquid discharged at this time is determined by the size of the liquid chamber. Therefore, as compared with the case where the pressurizing portion pressurizes the inside of the second storage portion, a slight pressurizing enough to break the meniscus formed in the nozzle can be applied to the liquid ejecting head with higher accuracy.

(O) In the control method of a liquid ejecting apparatus, the pressurizing mechanism may include the pressurizing portion, an air chamber separated from the liquid chamber via the flexible member, and an air flow path through which the pressurizing portion communicates with the air chamber, and the performing of the slight pressurization-discharge may further include pressurizing the flexible member by sending pressurized air to the air chamber by the pressurizing portion.

With this method, in the slight pressurization-discharge, the pressurizing portion pressurizes the air chamber via the air flow path, and pressurizes the flexible member. Therefore, the pressurizing portion can pressurize the liquid in the second storage portion and the liquid in the liquid chamber.

(P) In the control method of a liquid ejecting apparatus, the liquid ejecting apparatus may further include a second valve provided in the supply flow path between the second storage portion and the liquid ejecting head, and configured to open and close the supply flow path, a collection flow path for collecting the liquid from the liquid ejecting head to the first storage portion, and a third valve configured to open and close the collection flow path, the control method may further include performing a head replacement routine, and the performing of the head replacement routine may include closing the communication passage by the first valve, opening the supply flow path by the second valve, closing the collection flow path by the third valve, pressurizing the inside of the second storage portion by the pressurizing portion to discharge, from the nozzle, the liquid from the second storage portion to the liquid ejecting head, opening the collection flow path by the third valve, and pressurizing the inside of the second storage portion by the pressurizing portion to collect the liquid in the collection flow path to the first storage portion.

With this method, in the head replacement routine, the communication passage and the collection flow path are closed, and the inside of the second storage portion is pressurized in a state where the supply flow path is opened, so that the liquid in the second storage portion, the supply flow path, and the liquid ejecting head is discharged from the nozzle. After that, the inside of the second storage portion is pressurized in a state where the communication passage is closed and the collection flow path and the supply flow path are open, so that the liquid in the collection flow path is collected in the first storage portion. Therefore, since the replacement of the liquid ejecting head is performed in a state where the liquid is discharged from the supply flow path, the liquid ejecting head, and the collection flow path, it is possible to suppress the dripping of liquid from the supply flow path, the liquid ejecting head, and the collection flow path.

(Q) In the control method of a liquid ejecting apparatus, printing may be performed by the liquid ejecting head ejecting the liquid to a medium, in a case where an ejection flow rate when the liquid ejecting head ejects the liquid to the medium is less than a threshold value, the printing may be performed in a state where the supply flow path is opened by the second valve and the collection flow path is closed by the third valve, and in a case where the ejection flow rate when the liquid ejecting head ejects the liquid to the medium is equal to or greater than the threshold value, the printing may be performed in a state where the supply flow path is opened by the second valve and the collection flow path is opened by the third valve.

With this method, in a case where the ejection flow rate when ejecting the liquid to the medium is equal to or greater than the threshold value, the supply flow path and the collection flow path are opened. Since the liquid is supplied to the liquid ejecting head not only from the supply flow path but also from the collection flow path, the required amount of liquid can be easily supplied.

What is claimed is:

1. A liquid ejecting apparatus comprising:

a liquid ejecting head configured to eject a liquid from a nozzle provided on a nozzle surface;

a first storage portion that has an introduction portion into which the liquid accommodated in a liquid accommodating portion is introduced, the introduction portion being provided at an upper portion of the first storage portion, the first storage portion being configured so that a liquid level fluctuates in a range lower than the nozzle surface;

a second storage portion that communicates with the first storage portion via a communication passage and to which the liquid is supplied from the first storage portion due to a water head difference;

a supply flow path for supplying the liquid from the second storage portion to the liquid ejecting head;

a pressurizing portion that pressurizes an inside of the second storage portion by sending air in the second storage portion; and a first valve configured to close the communication passage at the time of pressurization by the pressurizing portion.

2. The liquid ejecting apparatus according to claim 1, further comprising:

a second valve provided in the supply flow path between the second storage portion and the liquid ejecting head, and configured to open and close the supply flow path.

3. The liquid ejecting apparatus according to claim 1, further comprising:

a collection flow path for collecting the liquid from the liquid ejecting head to the first storage portion; and a third valve configured to open and close the collection flow path.

4. The liquid ejecting apparatus according to claim 3, further comprising:

a slight pressurizing portion that has a liquid chamber partially composed of a flexible member and a pressurizing mechanism configured to pressurize the flexible member from an outside of the liquid chamber, the slight pressurizing portion being provided in the collection flow path between the liquid ejecting head and the third valve.

5. The liquid ejecting apparatus according to claim 4, wherein the pressurizing mechanism includes the pressurizing portion, an air chamber separated from the liquid chamber via the flexible member, and an air flow path through which the pressurizing portion communicates with the air chamber.

6. The liquid ejecting apparatus according to claim 3, wherein a first coupling portion between the liquid ejecting head and the collection flow path is disposed at a position higher than a second coupling portion between the liquid ejecting head and the supply flow path.

7. The liquid ejecting apparatus according to claim 1, wherein the first valve includes a check valve that allows a flow of the liquid from the first storage portion to the second storage portion and restricts a flow of the liquid from the second storage portion to the first storage portion.

8. The liquid ejecting apparatus according to claim 1, wherein the liquid ejecting head is disposed so that the nozzle surface is inclined with respect to a horizontal.

9. The liquid ejecting apparatus according to claim 1, wherein a liquid level of the second storage portion is maintained at substantially the same level as the liquid level of the first storage portion such that liquid level of the second storage portion fluctuates in a range lower than the nozzle level.

10. A control method of a liquid ejecting apparatus including a liquid ejecting head that ejects a liquid from a nozzle provided on a nozzle surface, a first storage portion that has an introduction portion into which the liquid accommodated in a liquid accommodating portion is introduced, the introduction portion being provided at an upper portion of the first storage portion, the first storage portion being configured so that a liquid level, a second storage portion that communicates with the first storage portion via a communication passage, a supply flow path for supplying the liquid from the second storage portion to the liquid ejecting head, a first valve configured to open and close the communication passage, and a pressurizing portion that pressurizes an inside of the second storage portion by sending air in the second storage portion, the control method comprising:

performing a pressurization-discharge, wherein the performing of the pressurization-discharge includes closing the communication passage by the first valve, and pressurizing the inside of the second storage portion by the pressurizing portion to discharge the liquid from the nozzle.

11. The control method of a liquid ejecting apparatus according to claim 10, wherein the liquid ejecting apparatus further includes a second valve provided in the supply flow path between the second storage portion and the liquid ejecting head, and configured to open and close the supply flow path, the control method further comprises performing an accumulation-discharge, and the performing of the accumulation-discharge includes closing the communication passage by the first valve, closing the supply flow path by the second valve, and pressurizing the inside of the second storage portion by the pressurizing portion and then opening the supply flow path by the second valve to discharge the liquid from the nozzle.

12. The control method of a liquid ejecting apparatus according to claim 11, wherein, in the performing of the accumulation-discharge, performing a first accumulation-discharge in which the supply flow path is opened by the second valve while the inside of the second storage portion is pressurized with a first pressure, and performing a second accumulation-discharge in which the supply flow path is opened by the second valve while the inside of the second storage portion is pressurized with a second pressure lower than the first pressure.

13. The control method of a liquid ejecting apparatus according to claim 11, wherein, in the performing of the accumulation-discharge, performing a first accumulation-discharge in which a time for pressurizing the inside of the second storage portion by the pressurizing portion is a first time, and performing a second accumulation-discharge in which a time for pressurizing the inside of the second storage portion by the pressurizing portion is a second time shorter than the first time.

14. The control method of a liquid ejecting apparatus according to claim 10, wherein the liquid ejecting apparatus further includes a second valve provided in the supply flow path between the second storage portion and the liquid ejecting head, and configured to open and close the supply flow path, a collection flow path for collecting the liquid from the liquid ejecting head to the first storage portion, and a third valve configured to open and close the collection flow path, the control method further comprises performing a liquid circulation, and the performing of the liquid circulation includes closing the communication passage by the first valve, opening the supply flow path by the second valve, opening the collection flow path by the third valve, and pressurizing the inside of the second storage portion by the pressurizing portion to cause the liquid to flow from the second storage portion to the first storage portion via the liquid ejecting head.

15. The control method of a liquid ejecting apparatus according to claim 14, wherein printing is performed by the liquid ejecting head ejecting the liquid to a medium, in a case where an ejection flow rate when the liquid ejecting head ejects the liquid to the medium is less than a threshold value, the printing is performed in a state where the supply flow path is opened by the second valve and the collection flow path is closed by the third valve, and in a case where the ejection flow rate when the liquid ejecting head ejects the liquid to the medium is equal to or greater than the threshold value, the printing is performed in a state where the supply flow path is opened by the second valve and the collection flow path is opened by the third valve.

16. The control method of a liquid ejecting apparatus according to claim 10, wherein the liquid ejecting apparatus further includes a second valve provided in the supply flow path between the second storage portion and the liquid ejecting head, and configured to open and close the supply flow path, a collection flow path for collecting the liquid from the liquid ejecting head to the first storage portion, a third valve configured to open and close the collection flow path, and a slight pressurizing portion that pressurizes the liquid in the collection flow path, the slight pressurizing portion is provided in the collection flow path between the liquid ejecting head and the third valve, and has a liquid chamber partially composed of a flexible member and a pressurizing mechanism configured to pressurize the flexible member from an outside of the liquid chamber, the control method further comprises performing a slight pressurization-discharge, and the performing of the slight pressurization-discharge includes closing the supply flow path by the second valve, closing the collection flow path by the third valve, and pressurizing the flexible member by the pressurizing mechanism to discharge the liquid from the nozzle.

17. The control method of a liquid ejecting apparatus according to claim 16, wherein the pressurizing mechanism includes the pressurizing portion, an air chamber separated from the liquid chamber via the flexible member, and an air flow path through which the pressurizing portion communicates with the air chamber, and the performing of the slight pressurization-discharge further includes pressurizing the flexible member by sending pressurized air to the air chamber by the pressurizing portion.

18. The control method of a liquid ejecting apparatus according to claim 10, wherein the liquid ejecting apparatus further includes a second valve provided in the supply flow path between the second storage portion and the liquid ejecting head, and configured to open and close the supply flow path, a collection flow path for collecting the liquid from the liquid ejecting head to the first storage portion, and a third valve configured to open and close the collection flow path, the control method further comprises performing a head replacement routine, and the performing of the head replacement routine includes closing the communication passage by the first valve, opening the supply flow path by the second valve, closing the collection flow path by the third valve, pressurizing the inside of the second storage portion by the pressurizing portion to discharge, from the nozzle, the liquid from the second storage portion to the liquid ejecting head, opening the collection flow path by the third valve, and pressurizing the inside of the second storage portion by the pressurizing portion to collect the liquid in the collection flow path to the first storage portion.

19. A liquid ejecting apparatus comprising:

a liquid ejecting head configured to eject a liquid from a nozzle provided on a nozzle surface;

a first storage portion that has an introduction portion into which the liquid accommodated in a liquid accommodating portion is introduced, the introduction portion being provided at an upper portion of the first storage portion, the first storage portion being configured so that a liquid level fluctuates in a range lower than the nozzle surface;

a second storage portion that communicates with the first storage portion via a communication passage and to which the liquid is supplied from the first storage portion due to a water head difference;

a supply flow path for supplying the liquid from the second storage portion to the liquid ejecting head;

a pressurizing portion that pressurizes an inside of the second storage portion;

a first valve configured to close the communication passage at the time of pressurization by the pressurizing portion;

a collection flow path for collecting the liquid from the liquid ejecting head to the first storage portion;

a second valve configured to open and close the collection flow path; and a slight pressurizing portion that has a liquid chamber partially composed of a flexible member and a pressurizing mechanism configured to pressurize the flexible member from an outside of the liquid chamber, the slight pressurizing portion being provided in the collection flow path between the liquid ejecting head and the second valve.

* * * * *